US009812748B2

(12) United States Patent
Kroening

(10) Patent No.: US 9,812,748 B2
(45) Date of Patent: Nov. 7, 2017

(54) TWIST FOR CONNECTING ORTHOGONAL WAVEGUIDES IN A SINGLE HOUSING STRUCTURE

(71) Applicant: Honeywell International Inc., Morris Plains, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/172,828

(22) Filed: Jun. 3, 2016

(65) Prior Publication Data

US 2016/0285147 A1 Sep. 29, 2016

Related U.S. Application Data

(62) Division of application No. 13/948,258, filed on Jul. 23, 2013, now Pat. No. 9,406,987.

(51) Int. Cl.
*H01P 1/18* (2006.01)
*H01P 1/02* (2006.01)
(Continued)

(52) U.S. Cl.
CPC ..... *H01P 1/022* (2013.01); *H01P 1/02* (2013.01); *H01P 1/165* (2013.01); *H01P 1/182* (2013.01);
(Continued)

(58) Field of Classification Search
CPC .. H01P 1/022; H01P 1/02; H01P 1/165; H01P 1/182; H01P 3/123; H01P 11/00; H01P 11/002
(Continued)

(56) References Cited

U.S. PATENT DOCUMENTS 2,975,383 A 3/1961 Seling
5,083,099 A 1/1992 Lagerlof
(Continued)

FOREIGN PATENT DOCUMENTS

EP 0392999 10/1990
EP 1296404 3/2003
(Continued)

OTHER PUBLICATIONS

European Patent Office, "Extended European Search Report from EP Application No. 14176424.1 dated Dec. 18, 2014", "from Foreign Counterpart of U.S. Appl. No. 13/948,258", dated Dec. 18, 2014, pp. 1-7, Published in: EP.
(Continued)

*Primary Examiner* — Robert Pascal
*Assistant Examiner* — Kimberly Glenn
(74) *Attorney, Agent, or Firm* — Fogg & Powers LLC

(57) ABSTRACT

A twist for coupling radiation between orthogonal waveguides is provided. The twist includes at least three cavities opening from at least one of a first X1-Y1 surface and a second X2-Y2 surface of a metal block. A first cavity has a first opening in a first Y-Z plane and a second opening in a second Y-Z plane offset from the first Y-Z plane by a first length. A second cavity shares the second opening with the first cavity and has a third opening in a third Y-Z plane offset from the second Y-Z plane by a second length and has at least two heights and at least two widths. A last cavity shares a next-to-last opening in a next-to-last Y-Z plane with a next-to-last cavity. The last cavity has a last opening in a last Y-Z plane offset from the next-to-last Y-Z plane by a last length.

4 Claims, 17 Drawing Sheets

(51) Int. Cl.
*H01P 3/123* (2006.01)
*H01P 1/165* (2006.01)
*H01P 11/00* (2006.01)

(52) U.S. Cl.
CPC ..... *H01P 3/123* (2013.01); *H01P 11/00* (2013.01); *H01P 11/002* (2013.01); *Y10T 29/49016* (2015.01)

(58) Field of Classification Search
USPC ..... 333/157
See application file for complete search history.

(56) References Cited

U.S. PATENT DOCUMENTS

| | | | | |
|---|---|---|---|---|
| 5,398,010 | A | 3/1995 | Klebe | |
| 6,031,434 | A | 2/2000 | Tatomir et al. | |
| 6,087,908 | A | 7/2000 | Haller et al. | |
| 6,225,875 | B1 | 5/2001 | Kich | |
| 6,313,714 | B1 | 11/2001 | Junker et al. | |
| 6,583,683 | B2 | 6/2003 | Schubert et al. | |
| 6,724,277 | B2 | 4/2004 | Holden et al. | |
| 6,756,861 | B2 | 6/2004 | Rosenberg et al. | |
| 6,879,221 | B2 | 4/2005 | Beis et al. | |
| 6,906,685 | B2 | 6/2005 | English et al. | |
| 6,995,628 | B2 * | 2/2006 | Asao | H01P 1/025 333/21 A |
| 7,106,153 | B2 * | 9/2006 | Chang | H01P 1/042 333/249 |
| 7,212,087 | B2 | 5/2007 | Nagai | |
| 7,330,088 | B2 | 2/2008 | Aramaki et al. | |
| 7,554,505 | B2 | 6/2009 | Haziza | |
| 7,656,359 | B2 | 2/2010 | Haziza | |
| 7,772,939 | B2 * | 8/2010 | Watanabe | H01P 1/165 333/21 A |
| 7,808,337 | B2 | 10/2010 | Rosenberg et al. | |
| 7,847,652 | B1 | 12/2010 | Chen et al. | |
| 7,847,749 | B2 | 12/2010 | Haziza | |
| 9,203,128 | B2 * | 12/2015 | Hoover | H01P 1/022 |
| 2001/0011933 | A1 | 8/2001 | Enokuma | |
| 2004/0246062 | A1 | 12/2004 | Asao et al. | |
| 2009/0309674 | A1 | 12/2009 | Girard et al. | |
| 2011/0037534 | A1 | 2/2011 | Espino et al. | |
| 2012/0032867 | A1 | 2/2012 | Fonseca | |
| 2012/0039566 | A1 * | 2/2012 | Ruiz Cruz | H01P 1/165 385/28 |
| 2014/0104017 | A1 | 4/2014 | Hoover et al. | |

FOREIGN PATENT DOCUMENTS

| | | |
|---|---|---|
| EP | 2432070 | 11/2010 |
| EP | 2355234 | 8/2011 |
| EP | 2493007 | 8/2012 |
| WO | 2005034278 | 4/2005 |
| WO | 2007057389 | 5/2007 |
| WO | 2007110110 | 10/2007 |
| WO | 2008008702 | 1/2008 |
| WO | 2011069598 | 6/2011 |

OTHER PUBLICATIONS

U.S. "Notice of Allowance", "U.S. Appl. No. 13/948,258", dated Apr. 1, 2016, pp. 1-7.
U.S. "Restriction Requirement", "U.S. Appl. No. 13/948,258", dated May 15, 2015, pp. 1-4.
U.S. "Office Action", "U.S. Appl. No. 13/948,258", dated Sep. 11, 2015, pp. 1-22.
Alison, "A Handbook for the Mechanical Tolerancing of Waveguide Components", Feb. 2007, pp. 1-3.
Bornemann et al., "Edge-Conditioned Vector Basis Functions for the Analysis and Optimization of Rectangular Waveguide Dual-Mode Filters", Jun. 1999, pp. 1-4.
Deloach, Jr., "Step-Twist-Junction Waveguide Filters", "IRE Transactions on Microwave Theory and Techniques", Mar. 1961, pp. 130-135.
Dunning, "Double Ridged Orthogonal Mode Transducer for the 16-26GHz Microwave Band", Feb. 2002, pp. 1-3, Publisher: CSIRO Australia Telescope National Facility.
Hwang et al., "Compact Orthomode Transducer using Single-Ridged Triangular Waveguides", "IEEE Microwave and Wireless Components letters", Aug. 2011, pp. 412-414.
Lenzing et al., "Machined Waveguide Twist", "IEEE Transactions on Microwave Theory and Techniques", Jul. 1990, pp. 942-944, vol. 38, No. 7.
Rosenberg, "A Compact and Broadband 90-Degree Waveguide Twist Transformer for Integrated Waveguide Subsystems", Sep. 2001, pp. 1-4.
Hoover et al., "Compact Twist for Connecting Orthogonal Waveguides", "U.S. Appl. No. 13/652,684", filed Oct. 16, 2012, pp. 1-26.
Wheeler et al., "Step-Twist Waveguide Components", "IRE Transaction—Microwave Theory and Techniques", Oct. 1955, pp. 44-52.
European Patent Office, "Communication Pursuant to Article 94(3) for EP Application No. 14176424.1", "Foreign Counterpart to U.S. Appl. No. 13/948,258", dated Aug. 1, 2017, pp. 1-3, Published in: EP.

* cited by examiner

TWIST FOR CONNECTING ORTHOGONAL WAVEGUIDES IN A SINGLE HOUSING STRUCTURE

CROSS-REFERENCE TO RELATED APPLICATION

The application is a divisional of pending U.S. application Ser. No. 13/948,258, entitled TWIST FOR CONNECTING ORTHOGONAL WAVEGUIDES IN A SINGLE HOUSING STRUCTURE filed Jul. 23, 2013, the disclosure of which is incorporated herein by reference.

BACKGROUND

In the packaging of a waveguide system it is sometimes necessary to change the axial orientation of the waveguide by 90 degrees along the length of a waveguide run. For example, the axial orientation of the waveguide may be required to change from an H-plane orientation to an E-plane orientation or the other way around. For a linearly-polarized antenna, an E-plane is the plane containing the electric field vector in the direction of maximum radiation. An H-plane is the plane containing the magnetic field vector in the direction of maximum radiation. The magnetizing field or H-plane is orthogonal to the E-plane.

The electric field or E-plane determines the polarization and orientation of the radio wave. For a vertically-polarized antenna, the E-plane usually coincides with the vertical/elevation plane and the H-plane coincides with the horizontal/azimuth plane. For a horizontally-polarized antenna, the E-plane usually coincides with the horizontal/azimuth plane and the H-plane coincides with the vertical/elevation plane.

Conventionally, a twist or rotation of the E-field is achieved with an additional curved waveguide section that physically forces the rotation of the orientation of the E-field (and H-field) by 90 degrees as the electro-magnetic (EM) radiation propagates along the length of the curved waveguide. A waveguide that physically forces the rotation of the E-field orientation requires a relatively long waveguide length. Some shorter length twists are currently available. In one example, an additional waveguide section consisting of two quarter wavelength sections orientated at 30 and 60 degrees is placed between the orthogonal waveguides.

Some systems, such as a tightly integrated ferrite switch feed network for an antenna array, require the rotation of an electro-magnetic field from an H-plane orientation to an E-plane orientation to occur within an integrated housing structure, such as a machined aluminum structure. To incorporate such a twist, these assemblies include a feed network that is split into separate E-plane parts, twist parts, and H-plane parts. Thick flanges are required to attach these separate E-plane, twist, and H-plane parts to each other. The positions of the bolts used to attach the various parts must be carefully chosen to ensure the bolt does not protrude into the region of the twisting waveguide.

SUMMARY

The present application relates to a twist for coupling electro-magnetic radiation between orthogonal waveguides. The twist includes at least three cavities having at least three respective shapes, the at least three cavities opening from at least one of a first X1-Y1 surface of a metal block and an opposing second X2-Y2 surface of the metal block. The at least three cavities include a first cavity, a second cavity, and a last cavity. The first cavity has a first opening in a first Y-Z plane and a second opening in a second Y-Z plane that is offset from the first Y-Z plane by a first length along an X axis. The second cavity shares the second opening in the second Y-Z plane with the first cavity and has a third opening in a third Y-Z plane that is offset from the second Y-Z plane by a second length along the X axis. The second cavity has at least two heights and at least two widths. The last cavity shares a next-to-last opening in a next-to-last Y-Z plane with a next-to-last cavity. The last cavity has a last opening in a last Y-Z plane that is offset from the next-to-last Y-Z plane by a last length along the X axis. The orthogonal waveguides are formed from the first cavity and the last cavity.

The details of various embodiments of the claimed invention are set forth in the accompanying drawings and the description below. Other features and advantages will become apparent from the description, the drawings, and the claims.

DRAWINGS

Like reference numbers and designations in the various drawings indicate like elements.

DETAILED DESCRIPTION

The above referenced problems are overcome by a twist formed from a single flange-less housing structure for connecting orthogonal waveguides between which electro-magnetic fields can be coupled over a relatively short straight length. The present application relates to a compact interfacing device for rotating electro-magnetic fields between an input waveguide and an orthogonal output waveguide. The interfacing device includes at least one interfacing cavity that is machined, along with and between an input cavity and an output cavity, from a single metal block. With the attachment of a metal cover over the machined surface, the interfacing cavity, the input cavity, and the output cavity become an interfacing waveguide, an input waveguide, and an output waveguide, respectively. The input waveguide is orthogonal to the output waveguide. Embodiments of the twists described herein include at least one metal cover that caps the input cavity and output cavity and one or more intermediate cavity formed from the single metal block. The twists described herein couple the electro-magnetic radiation between the orthogonal waveguides via the one or more intermediate waveguides. In one implementation of this embodiment, the electro-magnetic radiation is in the radio frequency (RF) spectral range. In another implementation of this embodiment, the electro-magnetic radiation is in the microwave frequency spectral range.

Specifically, the one or more intermediate waveguides rotate by 90 degrees the E-field of electro-magnetic radiation propagating from an input waveguide (also referred to herein as a first waveguide) to an output waveguide (also referred to herein as a last waveguide). The lengths of the intermediate waveguides are about a quarter-wavelength ($\lambda/4$) of the wavelength $\lambda$ of the radiation propagating in the twist. The adjacent machined cavities are open to each other by shared openings. The first waveguide and the last waveguide have respective openings on opposing outer surfaces of the single housing structure and do not require any flanges for attaching bolts.

In one implementation of this embodiment, the twists described herein are formed by machining the cavities for orthogonal waveguides and the one or more intermediate waveguides from a surface of a single metal block and then attaching a metal cover to the machined surface. In another implementation of this embodiment, the twists described herein are formed by machining the cavities for the orthogonal waveguides and the one or more intermediate waveguides from two opposing surfaces of a single metal block and then attaching two metal covers to the two opposing machined surfaces.

The single housing structure is constructed by machining the cavities from a metal block using standard equipment, such as an end mill in a milling machine or any other available equipment to form cavities in a metal surface.

Figure 1:
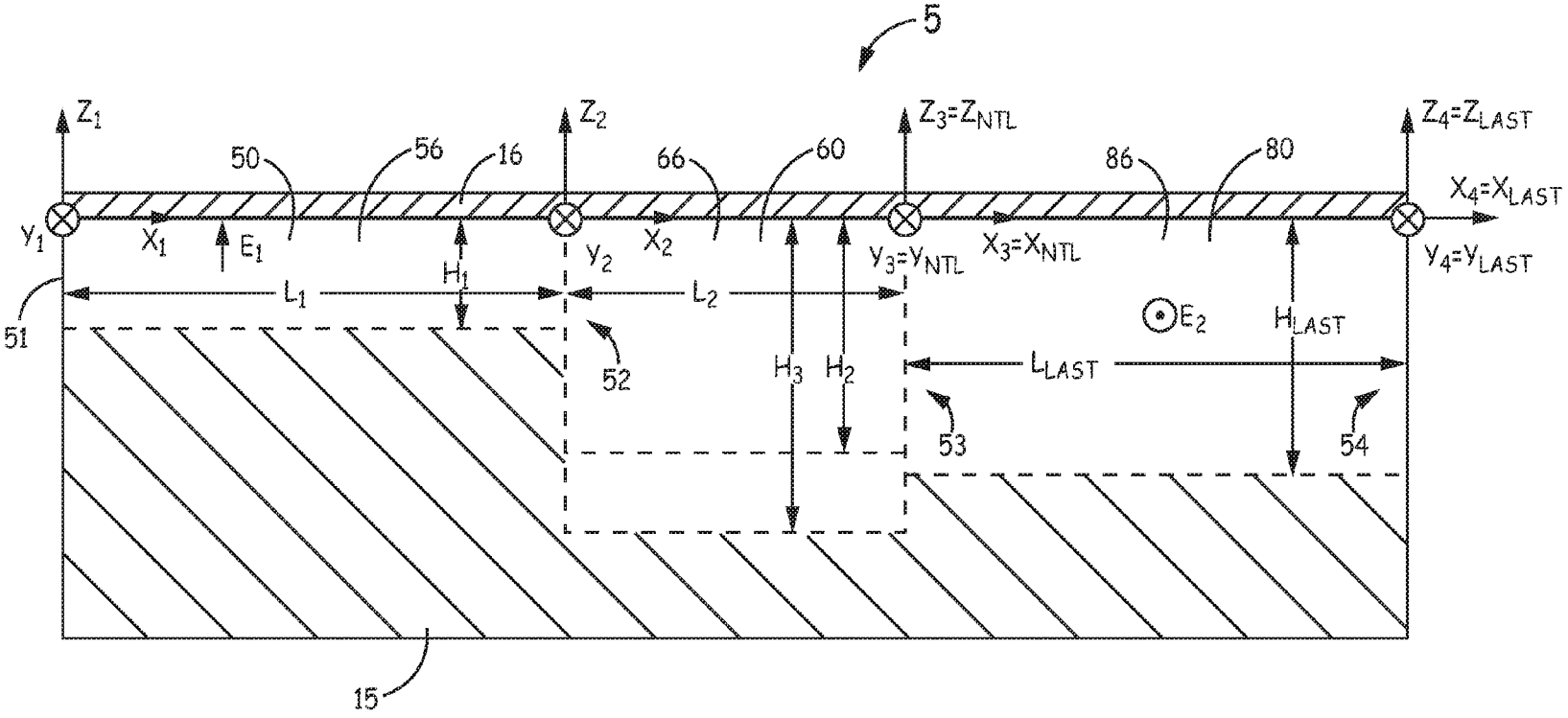
FIG. 1 is a side cross-sectional view of one embodiment of a twist in accordance with the teachings of the present application.
Figure 2:
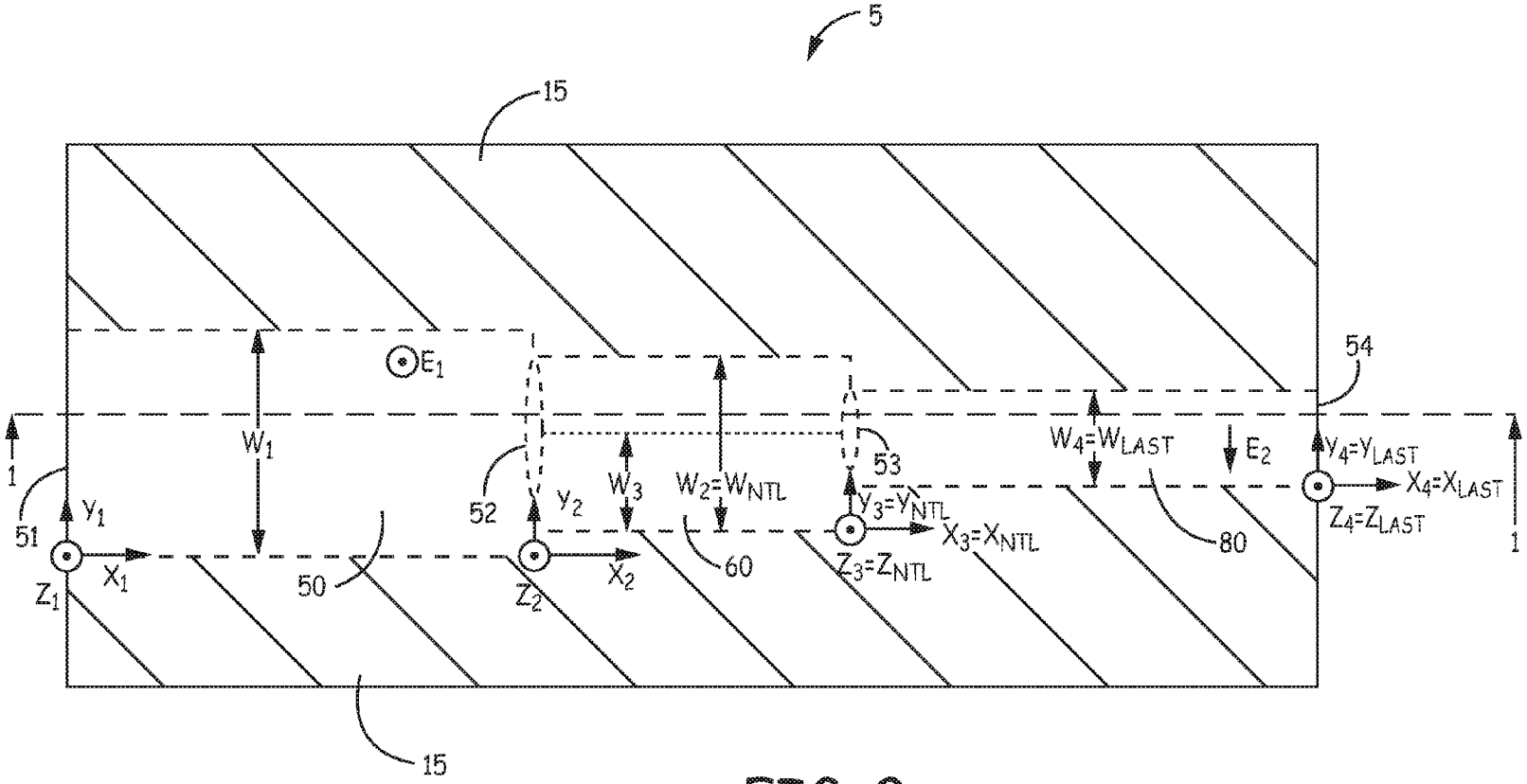
FIG. 2 is a top cross-sectional view of the twist of FIG. 1.

FIG. 1 is a side cross-sectional view of one embodiment of a twist 5 in accordance with the teachings of the present application. FIG. 2 is a top cross-sectional view of the twist 5 of FIG. 1. The plane upon which the cross-section view of FIG. 1 is taken is indicated by section line 1-1 in FIG. 2. The milling tool radius is not shown in FIGS. 1 and 2. As the electro-magnetic radiation propagates from the first waveguide 56 to the last waveguide 86 in the twist 5, the electric field vector $E_1$, which is parallel to the Z axis in the first waveguide 56, is rotated by 90 degrees to be parallel to the Y axis in the last waveguide 86 as indicated by the electric field vector $E_2$.

The twist 5 includes three cavities 50, 60, and 80 having three respective shapes that are formed in a metal block 15, and a cover 16. The metal cover 16 is a flat metal plate. As shown in FIG. 1, the three cavities 50, 60, and 80 open from a surface spanned by an $X_1$ axis and a $Y_1$ axis of a metal block 15. The surface spanned by the $X_1$ axis and the $Y_1$ axis is also referred to herein as a "$X_1$-$Y_1$ surface" and "a first $X_1$-$Y_1$ surface". In one implementation of this embodiment, the three cavities 50, 60, and 80 are opened from a surface spanned by an $X_1$ axis and a $Y_1$ axis by machining the cavities into the $X_1$-$Y_1$ surface. In another implementation of this embodiment, the three cavities 50, 60, and 80 are opened from a surface spanned by an $X_1$ axis and a $Y_1$ axis by laser drilling into the $X_1$-$Y_1$ surface. In yet another implementation of this embodiment, a plastic piece with the desired cavity shapes is formed and coated with metal.

The first cavity 50 has a first opening 51 in a first $Y_1$-$Z_1$ plane and a second opening represented generally at 52 in a second $Y_2$-$Z_2$ plane. The second $Y_2$-$Z_2$ plane is offset from the first $Y_1$-$Z_1$ plane by a first length $L_1$ (FIG. 1) along the X axis. The first cavity 50 has a width $W_1$ (FIG. 2) and a length $L_1$ (FIG. 1). The widths described herein are measured parallel to the Y axis. The lengths described herein are measured parallel to the X axis. The heights described herein are measured parallel to the Z axis.

A second cavity 60 shares the second opening 52 in the second $Y_2$-$Z_2$ plane with the first cavity 50. The second cavity 60 has a third opening represented generally at 53 in a third $Y_3$-$Z_3$ plane that is offset from the second $Y_2$-$Z_2$ plane by a second length $L_2$ (FIG. 1) along the X axis. The second length $L_2$ is about a quarter wavelength ($\lambda/4$) of the electro-magnetic radiation propagating through the twist 5 from the first opening 51 to the last opening 54. The second cavity 60 has two heights $H_2$ and $H_3$ (FIG. 1) and two widths $W_2$ and $W_3$ (FIG. 2) that are the result of a step formed in the second cavity 60. The rise of the step formed in the second cavity 60 is in an X-Z plane. The tread of the step formed in the second cavity 60 is in an X-Y plane. The second cavity 60 concurrently steps the height and width of the waveguide 66 formed from the second cavity 60 (when the metal cover 16 is attached) to provide the 90° twist effect.

A last cavity 80 shares a next-to-last opening 53 in a next-to-last Y-Z plane $Y_3$-$Z_3$ with a next-to-last cavity 60. In the embodiment shown in FIGS. 1 and 2, the next-to-last opening 53 in the next-to-last $Y_3$-$Z_3$ plane are the third opening 53 in the third $Y_3$-$Z_3$ plane and the next-to-last cavity 60 is the second cavity 60. The last cavity 80 has a last opening 54 in a last $Y_4$-$Z_4$ plane that is offset from the next-to-last Y-Z plane by a last length $L_{last}$ along the X axis. When the metal cover 16 (FIG. 1) is attached to the $X_1$-$Y_1$ surface, the orthogonal waveguides 56 and 86 of the twist 5 are formed from the first cavity 50 and the last cavity 80, respectively.

As shown in FIGS. 1 and 2, the height $H_1$ along a Z axis of the first cavity 50 is less than a height $H_{last}$ along a Z axis of the last cavity 80, a width $W_1$ along a Y axis of the first cavity 60 is greater than a width $W_{last}$ along a Y axis of the last cavity 80. In one implementation of this embodiment, the height $H_1$ along the Z axis of the first cavity 50 is about equal to the width $W_{last}$ along the Y axis of the last cavity 80 and the height $H_{last}$ along the Z axis of the last cavity 80 is about equal to the width $W_1$ along the Y axis of the first cavity 50.

As shown in FIG. 1, the cover 16 is attached to the $X_1$-$Y_1$ surface of the metal block 15, in which the cavities 50, 60, and 80 are formed, so the cavities 50, 60, and 80 form respective waveguides 56, 66, and 86. In this manner, when the metal cover 16 is attached to the $X_1$-$Y_1$ surface, the twist 5 is able to couple electro-magnetic radiation between the orthogonal waveguides 56 and 86 formed from the first cavity 50 and the last cavity 80. Specifically, when the metal cover 16 is attached to the first $X_1$-$Y_1$ surface, the first waveguide 56 is either an input waveguide or an output waveguide, while the last waveguide 86 is a respective one of the output waveguide or the input waveguide depending on the direction of propagation of the electro-magnetic radiation. The metal cover 16 is attached to the first $X_1$-$Y_1$ surface by one of a variety of ways including, but not limited to, adhesives, welding, solder, screws, and/or other fixtures.

The first opening 51 in the first $Y_1$-$Z_1$ plane is either the input to the input waveguide 56 or an output from the output waveguide 56 depending on the direction of propagation of the electro-magnetic radiation. The last opening 54 in the last $Y_4$-$Z_4$ plane is either the output from the output waveguide 86 or an input to the input waveguide 86 depending on the direction of propagation of the electro-magnetic radiation. When the metal cover 16 is attached to the $X_1$-$Y_1$ surface, the twist 5 is formed in a single housing structure without the need to attach a separate, bulky, curved prior art waveguide to the input and output waveguides with bolts connecting flanges on the waveguides.

In one implementation of this embodiment, the metal block 15 is made from aluminum and the metal cover 16 is made from aluminum. The metal block 15 and the metal cover 16 can be made from other metal materials.

Figure 3:
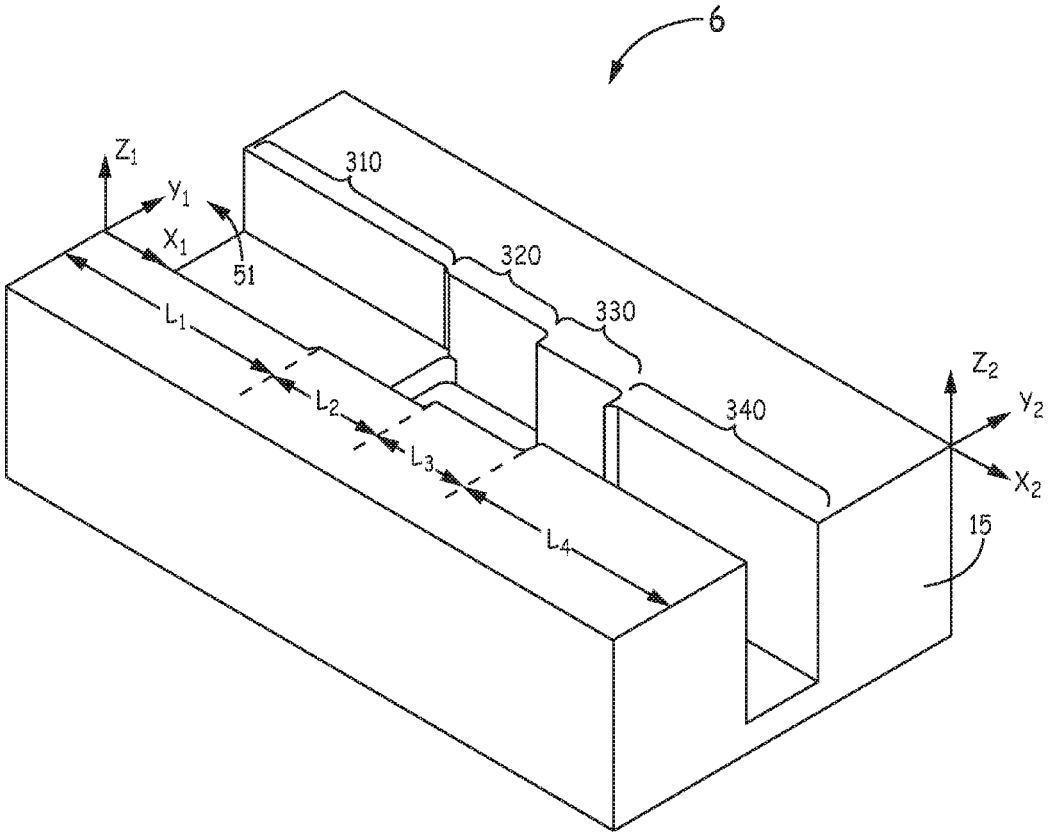
FIGS. 3 and 4 are oblique views of one embodiment of cavities for a twist formed in a metal block in accordance with the teachings of the present application.
Figure 4:
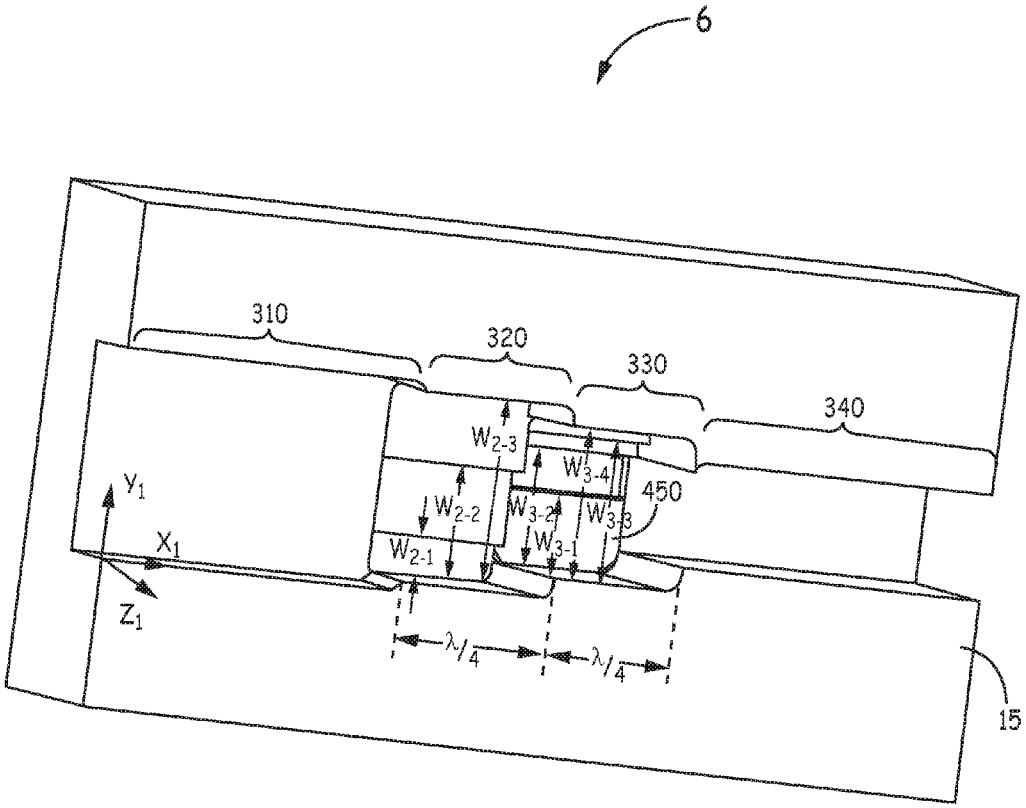

FIGS. 3 and 4 are oblique views of one embodiment of cavities 310, 320, 330, and 340 for a twist 6 formed in a metal block 15 in accordance with the teachings of the present application. When a metal cover (such as the metal cover 16 shown in FIG. 1) is attached to the $X_1$-$Y_1$ surface of the metal block 15, the resultant twist 6 couples electro-magnetic radiation between the orthogonal waveguides formed from the first cavity 310 and the last cavity 340. The interfacing device shown in FIGS. 3 and 4 consists of the two cavities 320 and 330 that are each approximately a quarter wavelength (λ/4) in length. The four cavities 310, 320, 330, and 340 have four respective shapes. The four cavities 310, 320, 330, and 340 are manufactured by milling all of the openings from the X1-Y1 plane. The milling tool radius is shown in FIGS. 3 and 4.

The first cavity 310 has a first opening 51 in the $Y_1$-$Z_1$ plane. The first opening 51 functions as an input port or output port of the waveguide formed from the first cavity 310 when the metal cover 16 is attached. The first cavity 310 has a second opening in a second $Y_2$-$Z_2$ plane offset from the $Y_1$-$Z_1$ plane by the length $L_1$ along the X axis.

The second cavity 320 has three heights (not labeled) and three widths $W_{2-1}$, $W_{2-2}$, and $W_{2-3}$ that are the result of two steps formed in the second cavity 320. The rises of the two steps formed in the second cavity 320 are in X-Z planes. The treads of the two steps formed in the second cavity 320 are in X-Y planes. The second cavity 320 shares the opening in the second Y-Z plane with the first cavity 310. The second cavity 320 has a third opening in a third Y-Z plane offset from the second Y-Z plane by a second length $L_2$ along the X axis. The second length $L_2$ is approximately a quarter wavelength (λ/4) in length. The three heights in the second cavity 320 are referred to herein as three second-cavity heights. The three widths in the second cavity 320 are referred to herein as three second-cavity heights.

The third cavity 330 has four heights (not labeled) and four widths $W_{3-1}$, $W_{3-2}$, $W_{3-3}$, and $W_{3-4}$ that are the result of three steps formed in the third cavity 330. The rises of the three steps formed in the third cavity 330 are in X-Z planes. The treads of the three steps formed in the third cavity 330 are in X-Y planes. The third cavity 330 shares the opening in the third Y-Z plane with the second cavity 320. The third cavity 330 has a fourth opening in a fourth Y-Z plane offset from the third Y-Z plane by a third length $L_3$ (FIG. 3) along the X axis. The third length $L_3$ is approximately a quarter wavelength (λ/4) in length. The four heights in the third cavity 330 are referred to herein as four third-cavity heights. The four widths in the third cavity 330 are referred to herein as four third-cavity heights. As shown in FIG. 4, $W_{3-1}<W_{3-2}<W_{3-3}<W_{3-4}$. The third cavity 330 is referred to herein as a next-to-last cavity 330. The fourth Y-Z plane referred to herein as a next-to-last Y-Z plane.

A dielectric material 450 is shown positioned in the floor of the third cavity 330. In one implementation of this embodiment, the dielectric material 450 is bonded to the floor of the third cavity 330. In one implementation of this embodiment, the dielectric material 450 has a dielectric constant of 4 or higher. In another implementation of this embodiment, the dielectric material 450 is formed from Corderite or Boron Nitride. The dielectric material 450 inserted in the third cavity 330 improves the bandwidth of the electro-magnetic radiation that can be rotated while propagating between the first waveguide formed from the first cavity 310 and the fourth waveguide formed from the fourth cavity 340.

The fourth cavity 340 is referred to herein as a last cavity 340. The last cavity 340 shares the next-to-last opening in the next-to-last Y-Z plane with the next-to-last cavity 330. The last cavity 340 has a last opening (fifth opening) in the last Y-Z plane (fifth Y-Z plane). The fifth Y-Z plane is offset from the fourth Y-Z plane by a fourth length $L_4$ along the X axis (FIG. 3). The fifth opening in the $Y_5$-$Z_5$ plane of the fourth cavity 340 is an input port or output port of the waveguide formed from the fourth cavity 340 when a metal cover is attached to the metal block 15.

The four cavities 310, 320, 330, and 340 concurrently step the height and width of the waveguide to provide the 90° twist effect. The interfacing device 320/330 formed from the two cavities 320 and 330 shown in FIGS. 3 and 4 provides a broader operating bandwidth than the single cavity interfacing device 60 shown in FIGS. 1 and 2. In another implementation of this embodiment, the interfacing device includes three cavities with steps positioned between the first and last cavities. As the number of interfacing cavities increases the operational bandwidth of the twist increases.

Figure 5:
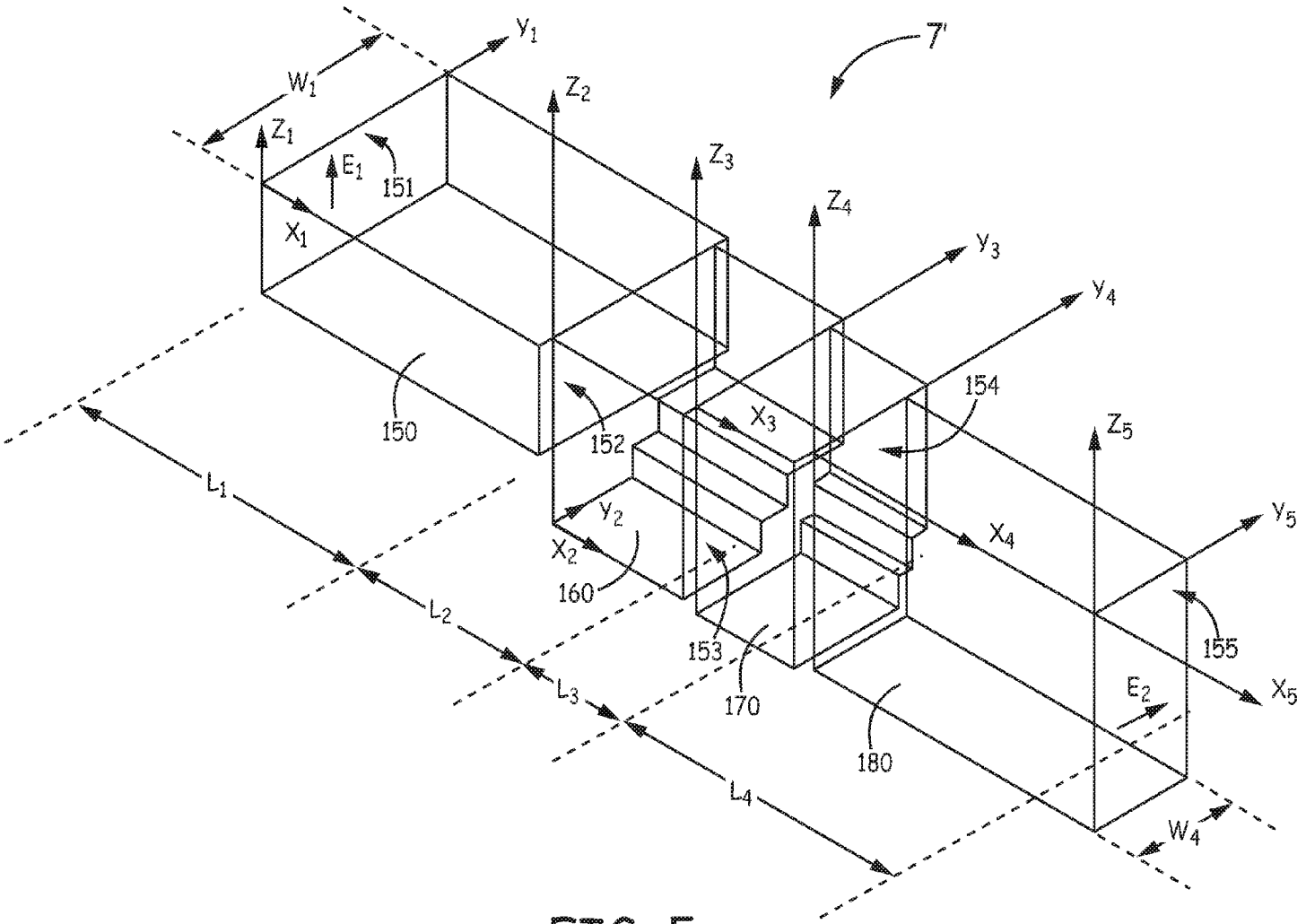
FIG. 5 is an oblique view of one embodiment of cavities in a twist in accordance with the teachings of the present application.
Figure 6:
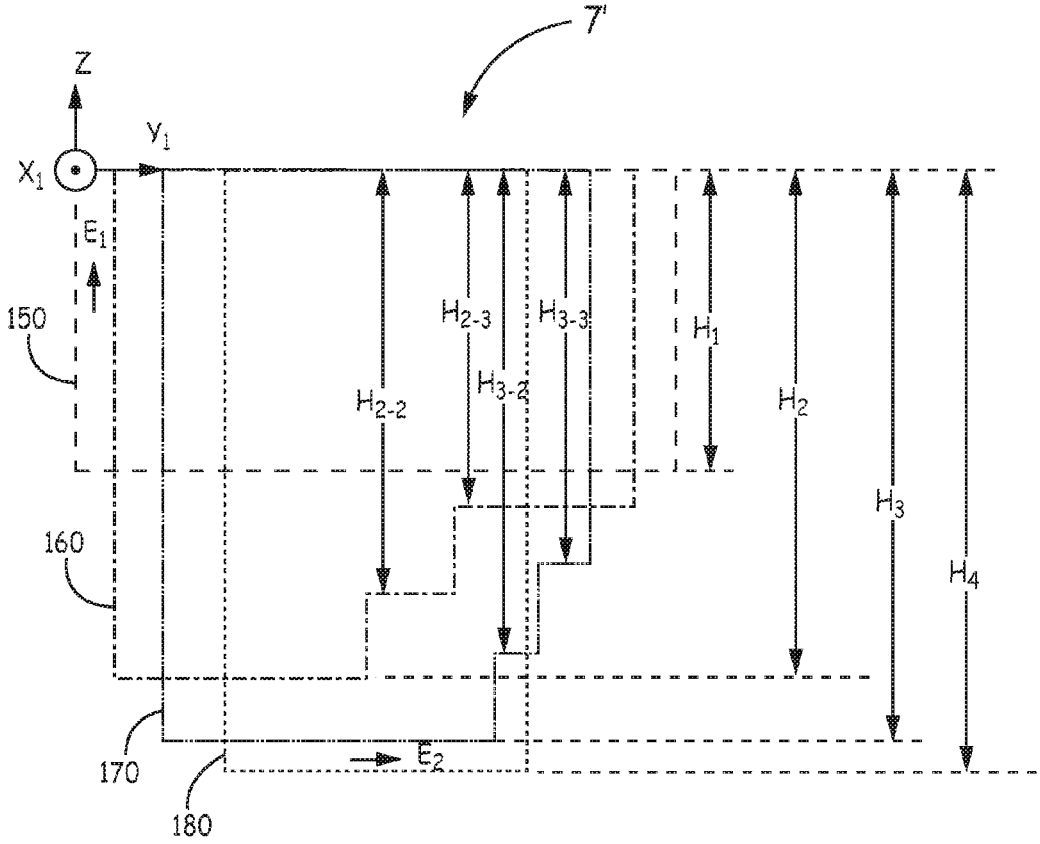
FIG. 6 is an end view of the cavities in the twist of FIG. 5.
Figure 7:
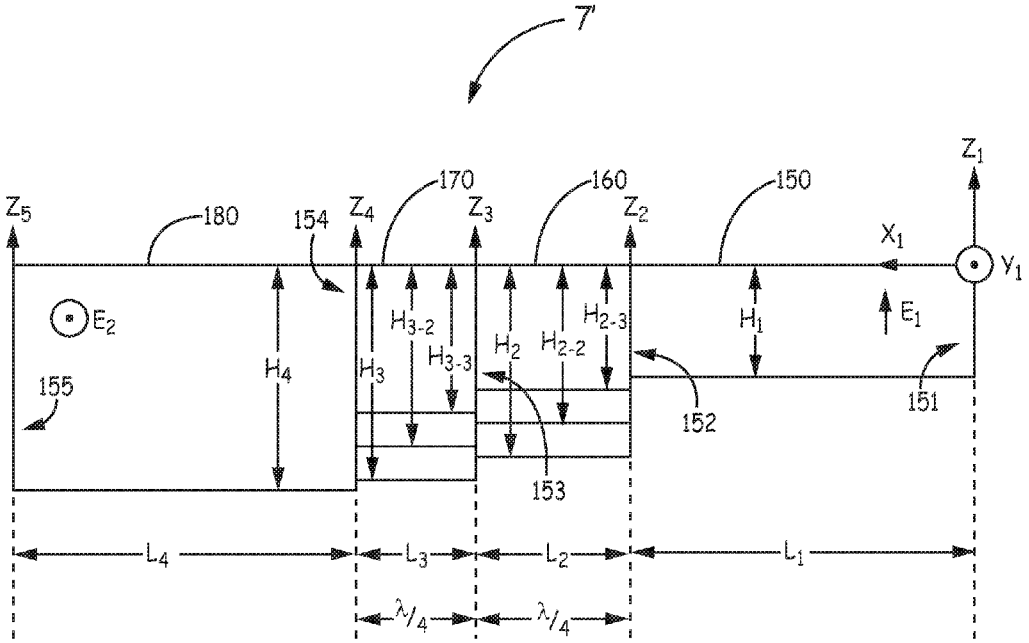
FIG. 7 is a side view of the cavities in the twist of FIG. 5.
Figure 8:
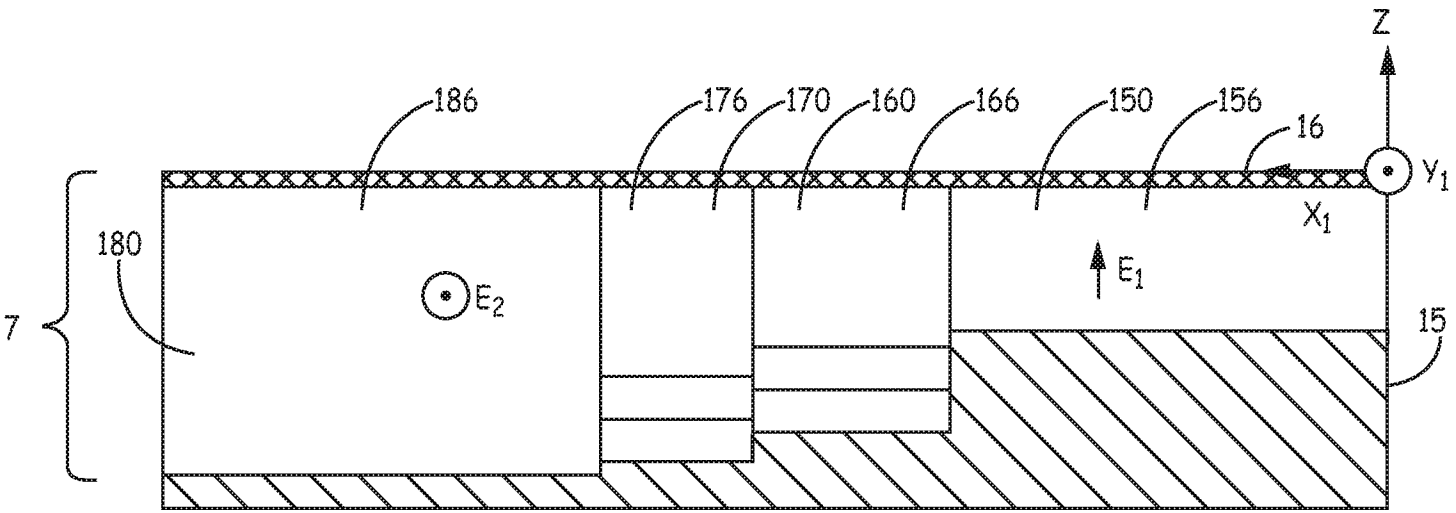
FIG. 8 is a side cross-sectional view of the twist with the cavities of FIG. 5.

FIG. 5 is an oblique view of one embodiment of cavities 150, 160, 170, and 180 in a twist 7' in accordance with the teachings of the present application. FIG. 6 is an end view of the cavities 150, 160, 170, and 180 in the twist 7' of FIG. 5. FIG. 7 is a side view of the cavities 150, 160, 170, and 180 in the twist 7' of FIG. 5. FIG. 8 is a side cross-sectional view of the twist 7 with the cavities of FIG. 5. As defined herein, the twist 7' includes the outlines of the cavities 150, 160, 170, and 180 in the twist 7 (FIG. 8) without the surrounding metal in order to clearly indicate the shapes of the cavities that are formed in metal shown in the twist 7 of FIG. 8. The four cavities 150, 160, 170, and 180 have four respective shapes. The cavities 150, 160, 170, and 180 represented generally as twist 7' are shown without the metal cover 16 in the twist 7 shown in FIG. 8. When the cover 16 is attached to the metal block 15 with the cavities 150, 160, 170, and 180, the cavities 150, 160, 170, and 180 form respective waveguides 156, 166, 176, and 186. As the electro-magnetic radiation propagates from the first waveguide 156 to the last waveguide 186 in the twist 7 (FIG. 8), the electric field vector $E_1$, which is parallel to the Z axis (e.g., perpendicular to the broad wall of the first waveguide 156) is rotated by 90 degrees to be output from the last waveguide 186 as the electric field vector $E_2$, which is parallel to the Y axis (e.g., perpendicular to the broad wall of the last waveguide 186)

The twist 7 is similar to the twist 6 of FIGS. 3 and 4 in that the interfacing device 160/170 includes two cavities 160 and 170 that interface with the first cavity 150 and the last cavity 180. The twist 7 does not include the dielectric material of twist 6. The interfacing device 160/170 shown in FIGS. 5-8 consists of 2 sections of approximately a quarter wavelength (λ/4) in length. These four cavities 150, 160, 170, and 180 concurrently step the height and width of the waveguide to provide the 90° twist effect, and they can be manufactured by milling all of the openings from $X_1$-$Y_1$ surface of the metal block 15 (FIG. 8). The milling tool radius is not shown in FIGS. 5-8.

When the metal cover 16 (FIG. 8) is attached to the $X_1$-$Y_1$ surface of the metal block 15 (FIG. 8), the resultant twist 7 couples electro-magnetic radiation between the orthogonal waveguides 156 and 186 (FIG. 8) formed from the first cavity 150 and the last cavity 180.

The first cavity 150 has a first opening 151 (FIGS. 5 and 7) (that is an input port or output port of the waveguide formed from the first cavity 150 when the metal cover is attached) in the $Y_1$-$Z_1$ plane and a second opening 152 (FIGS. 5 and 7) in a second $Y_2$-$Z_2$ plane offset from the $Y_1$-$Z_1$ plane by the length $L_1$ along the X axis.

The second cavity 160 has three heights $H_{2-3}$, $H_{2-2}$, $H_2$ (FIG. 6) and three widths (not labeled) that are the result of two steps formed in the second cavity 160. The rises of the two steps formed in the second cavity 160 are in X-Z planes. The treads of the two steps formed in the second cavity 160 are in X-Y planes. The second cavity 160 shares the second opening 152 (FIGS. 5 and 7) in the second Y-Z plane with the first cavity 150. The second cavity 160 has a third opening 153 (FIGS. 5 and 7) in a third Y-Z plane offset from the second Y-Z plane by a second length $L_2$ along the X axis. The second length $L_2$ is approximately a quarter wavelength (λ/4) in length. The three heights in the second cavity 160 are referred to herein as three second-cavity heights. As shown in FIG. 7, $H_{2-3}<H_{2-2}<H_2$. The three widths in the second cavity 160 are referred to herein as three second-cavity widths.

The third cavity 170 has three heights $H_{3-3}$, $H_{3-2}$, $H_3$ and three respective widths (not labeled) that are the result of the two steps formed in the third cavity 170. The rises of the two steps formed in the third cavity 170 are in X-Z planes. The treads of the two steps formed in the third cavity 170 are in X-Y planes. The third cavity 170 shares the third opening 153 (FIGS. 5 and 7) in the third Y-Z plane with the second cavity 160. The third cavity 170 has a fourth opening 154 (FIGS. 5 and 7) in a fourth Y-Z plane offset from the third Y-Z plane by a third length $L_3$ (FIGS. 5 and 7) along the X axis. The third length $L_3$ is approximately a quarter wavelength (λ/4) in length. The three heights in the third cavity 170 are referred to herein as three third-cavity heights. The three widths in the third cavity 170 are referred to herein as three third-cavity widths. As shown in FIG. 7, $H_{3-3}<H_{3-2}<H_3$. The third cavity 170 is referred to herein as a next-to-last cavity 170. The fourth Y-Z plane is referred to herein as a next-to-last Y-Z plane.

The fourth cavity 180 is referred to herein as a last cavity 180. The last cavity 180 shares the next-to-last opening 154 (FIGS. 5 and 7) in the next-to-last Y-Z plane with the next-to-last cavity 170. The last cavity 180 has a last opening (fifth opening) 155 (FIGS. 5 and 7) in the last Y-Z plane (fifth X-Y plane). The fifth Y-Z plane is offset from the fourth Y-Z plane by a fourth length $L_4$ along the X axis. The fifth opening 155 (FIGS. 5 and 7) in the $Y_5$-$Z_5$ plane of the fourth cavity 180 is an input port or output port of the waveguide 186 (FIG. 8) formed from the fourth cavity 180 when the metal cover 16 (FIG. 8) is attached to the metal block 15.

The interfacing device 160/170 formed from the two waveguides 166 and 176 (FIG. 8), which include the respective cavities 160 and 170 shown in FIGS. 5-8, provides a broader operating bandwidth than the single cavity interfacing device shown in FIGS. 1 and 2.

As shown in FIGS. 5-8, the height $H_1$ measured along a Z axis of the first cavity 150 is less than a height $H_4$ measured along a Z axis of the last cavity 180 (FIG. 7), a width $W_1$ (FIG. 5) along a Y axis of the first cavity 150 is greater than a width $W_4$ (FIG. 5) along a Y axis of the last cavity 180. In one implementation of this embodiment, the height $H_1$ along the Z axis of the first cavity 150 is about equal to the width $W_4$ along the Y axis of the last cavity 180 and the height $H_4$ along the Z axis of the last cavity 180 is about equal to the width $W_1$ along the Y axis of the first cavity 150.

Figure 9:
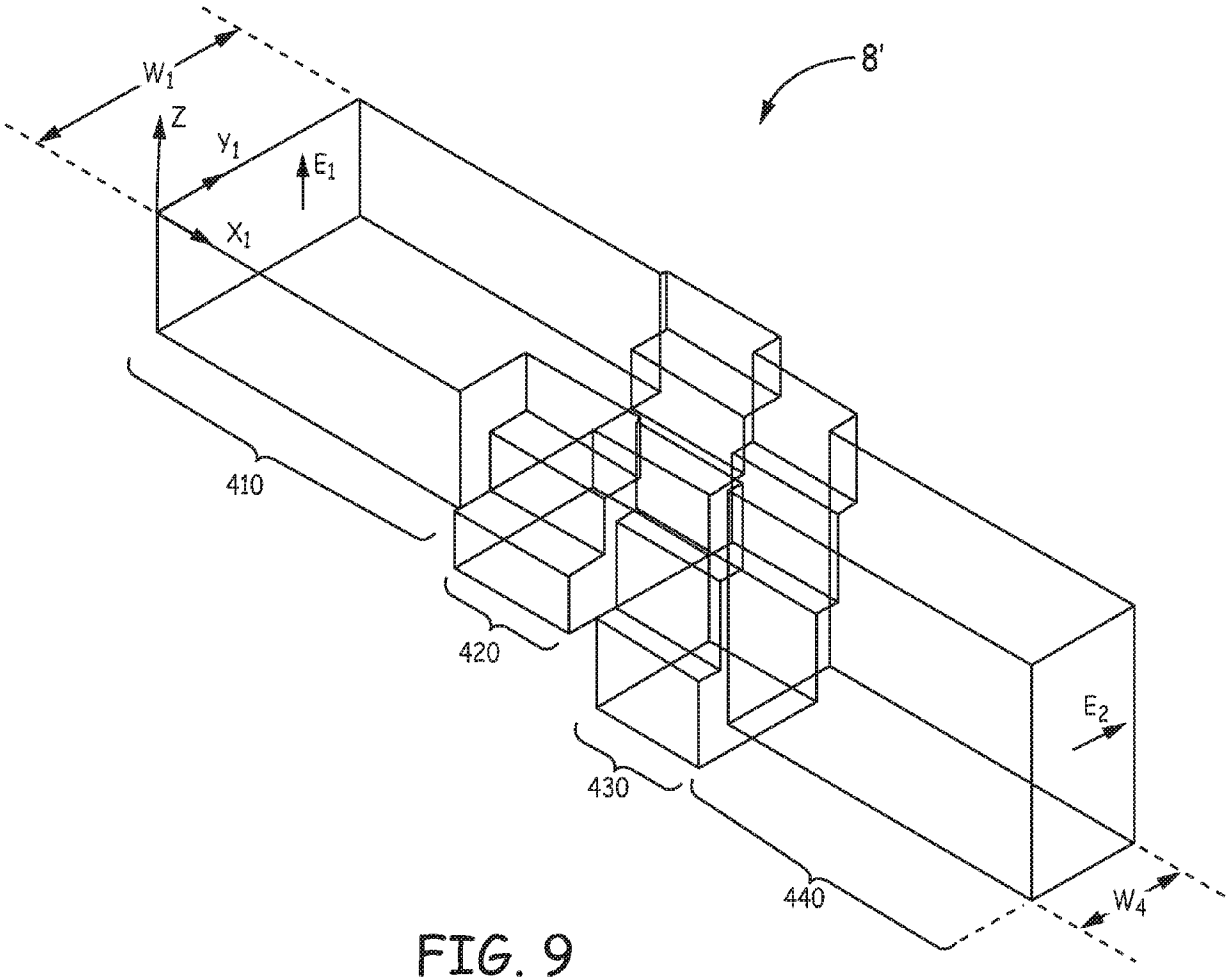
FIG. 9 is an oblique view of one embodiment of cavities in a twist in accordance with the teachings of the present application.
Figure 10:
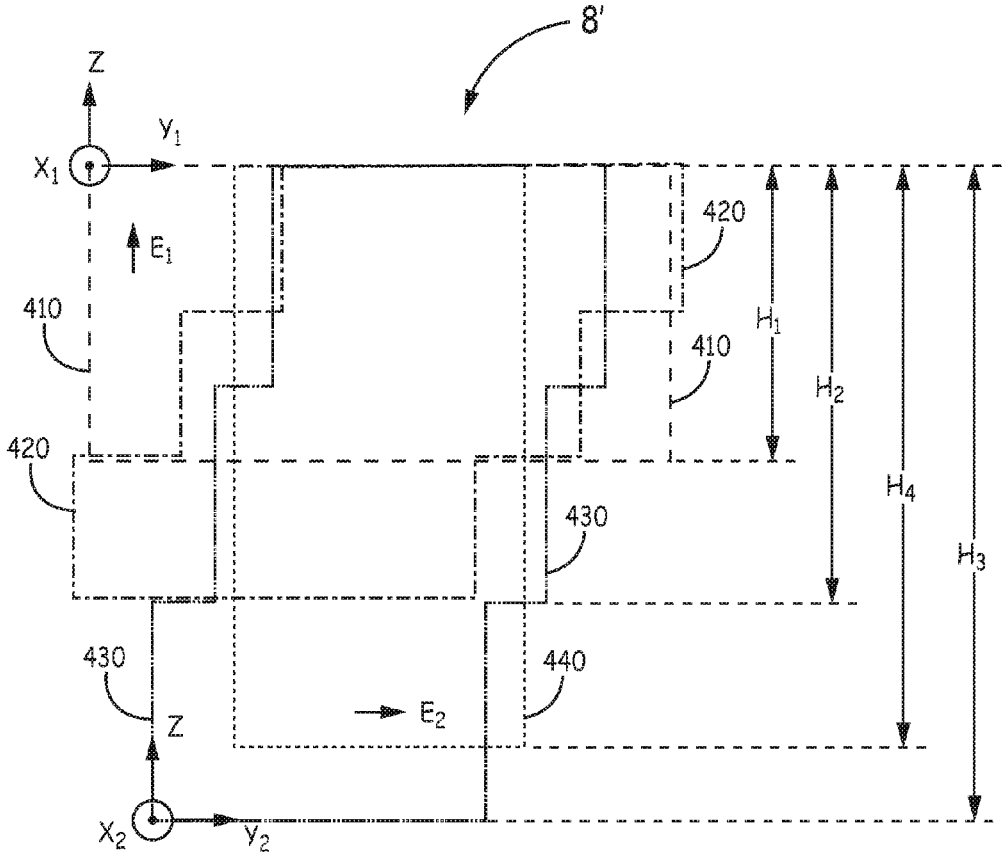
FIG. 10 is an end view of the cavities in the twist of FIG. 9.
Figure 11:
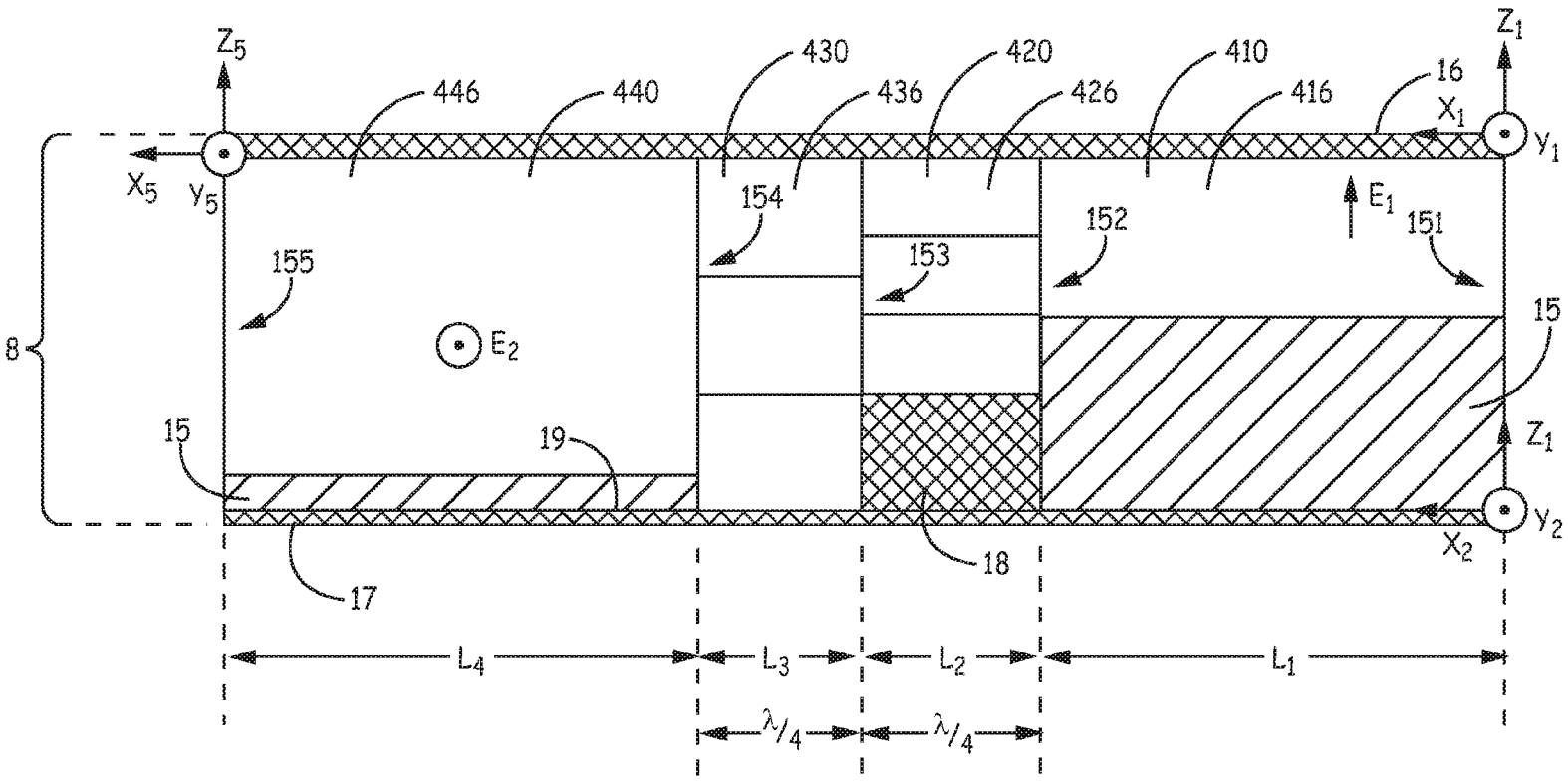
FIG. 11 is an side cross-sectional view of the twist with the cavities of FIGS. 9 and 10.

FIG. 9 is an oblique view of one embodiment of cavities 410, 420, 430, and 440 in a twist 8' in accordance with the teachings of the present application. FIG. 10 is an end view of the cavities 410, 420, 430, and 440 in the twist 8' of FIG. 9. FIG. 11 is a side cross-sectional view of the twist 8 with the cavities 410, 420, 430, and 440 of FIGS. 9 and 10. As defined herein, the twist 8' includes the outlines of the cavities 410, 420, 430, and 440 in the twist 8 (FIG. 11) without the surrounding metal in order to clearly indicate the shapes of the cavities 410, 420, 430, and 440 that are formed in metal shown in the twist 8 of FIG. 11. To form the twist 8 shown in FIG. 11, the metal cover 16 and metal cover 17 are attached to the metal block 15 in which the cavities 410, 420, 430, and 440 are formed. Specifically, when the metal cover 16 and the metal cover 17 are attached to the metal block 15, the cavities 410, 420, 430, and 440 form respective waveguides 416, 426, 436, and 446. The metal cover 16 is a flat sheet of metal. As shown in FIG. 11, the metal plate 17 includes a protrusion 18 that extends from a flat surface 19 of the metal cover 17. The protrusion 18 forms a surface of the waveguide 426 in the twist 8 (FIG. 11). The flat surface 19 of the metal cover 17 forms a surface of the waveguide 436 in the twist 8 (FIG. 11). When the metal cover 16 is attached to the first $X_1$-$Y_1$ surface and the metal cover 17 is attached to the second $X_2$-$Y_2$ surface, the twist 8 is formed in a single housing structure without the need to attach a separate, bulky, curved waveguide to the input and output waveguides with bolts. The metal cover 17 is attached to the second $X_2$-$Y_2$ surface by one of a variety of ways including, but not limited to, adhesives, solder, screws, and/or other fixtures.

As indicated, the cavities 410, 420, 430, and 440 in the metal block 15 represented generally as twist 8' are the portion of the twist 8 shown in FIG. 11 without the covers 16 and 17 shown in FIG. 11. The four cavities 410, 420, 430, and 440 have four respective shapes. The twist 8 is similar to the twist 7 of FIG. 8 in that the interfacing device 420/430 includes two cavities 420 and 430 that interface with the first cavity 410 and the last cavity 440. The two cavities 420 and 430 that form the interfacing device 420/430 shown in FIGS. 9-11 are approximately a quarter wavelength (λ/4) in length.

The twist 8 as shown does not include dielectric material; however dielectric material may be positioned in one or both of the waveguides 426 and 436.

The twist 8 is manufactured by milling cavities from two opposing surfaces of the metal block 15. The twist 8 is manufactured by milling cavities 410 and 440 and portions of cavities 420 and 430 from the surface of the metal block 15 spanned by the $X_1$ axis and the $Y_1$ axis (e.g., the first $X_1$-$Y_1$ surface) and by milling portions of the cavities 420 and 430 from the surface of the metal block 15 spanned by the $X_2$ axis and the $Y_2$ axis (FIG. 11). The surface spanned by the $X_2$ axis and the $Y_2$ axis is also referred to herein as an "$X_2$-$Y_2$ surface" and "a second $X_2$-$Y_2$ surface". The milling tool radius is not shown in FIGS. 9-11.

When the metal covers 16 and 17 (FIG. 11) are attached to the respective $X_1$-$Y_1$ surface and $X_2$-$Y_2$ surface of the metal block 15 (FIG. 11), the resultant twist 8 couples electro-magnetic radiation between the orthogonal waveguides 416 and 446 (FIG. 11) formed from the first cavity 410 and the last cavity 440. As the electro-magnetic radiation propagates from the first waveguide 416 to the last waveguide 446 in the twist 8, the electric field vector $E_1$, which is parallel to the Z axis in the first waveguide 416, is rotated by 90 degrees to be parallel to the Y axis in the last waveguide 446 as indicated by the electric field vector $E_2$.

The height $H_1$ along a Z axis of the first cavity 410 is less than a height $H_4$ along a Z axis of the last cavity 440 (FIG. 10), a width $W_1$ along a Y axis of the first cavity 410 is greater than a width $W_4$ along a Y axis of the last cavity 440 (FIG. 9). In one implementation of this embodiment, the height $H_1$ along the Z axis of the first cavity 410 is about equal to the width $W_4$ along the Y axis of the last cavity 440 and the height $H_4$ along the Z axis of the last cavity 440 is about equal to the width $W_1$ along the Y axis of the first cavity 410.

The first cavity 410 has a first opening 151 (FIG. 11), which is an input port or output port of the waveguide 416 formed from the first cavity 410 when the metal cover 16 is attached to the $X_1$-$Y_1$ surface. A second opening 152 (FIG. 11) in a second Y-Z plane offset from the $Y_1$-$Z_1$ plane by the length $L_1$ along the X axis.

The second cavity 420 has three heights (not labeled) and three widths (not labeled) that are the result of two steps formed in the second cavity 420. The rises of the two steps formed in the second cavity 420 are in X-Z planes. The treads of the two steps formed in the second cavity 420 are in X-Y planes. The second cavity 420 shares the second opening 152 (FIG. 11) in the second Y-Z plane with the first cavity 410. The second cavity 420 has a third opening 153 (FIG. 11) in a third Y-Z plane offset from the second Y-Z plane by a second length $L_2$ along the X axis. The second length $L_2$ is approximately a quarter wavelength ($\lambda/4$) in length. The three heights in the second cavity 420 are referred to herein as three second-cavity heights. The three widths in the second cavity 420 are referred to herein as three second-cavity heights.

The third cavity 430 has three heights (not labeled) and four widths (not labeled) that are the result of the two steps formed in the third cavity 430. The rises of the two steps formed in the third cavity 430 are in X-Z planes. The treads of the two steps formed in the third cavity 430 are in X-Y planes. The third cavity 430 shares the third opening 153 (FIG. 11) in the third Y-Z plane with the second cavity 420. The third cavity 430 has a fourth opening 154 (FIG. 11) in a fourth Y-Z plane offset from the third Y-Z plane by a third length $L_3$ (FIG. 11) along the X axis. The third length $L_3$ is approximately a quarter wavelength ($\lambda/4$) in length. The three heights in the third cavity 430 are referred to herein as three third-cavity heights. The three widths in the third cavity 430 are referred to herein as three third-cavity heights. The third cavity 430 is referred to herein as a next-to-last cavity 430. The fourth Y-Z plane referred to herein as a next-to-last Y-Z plane.

The fourth cavity 440 is referred to herein as a last cavity 440. The last cavity 440 shares the next-to-last opening 154 (FIG. 11) in the next-to-last Y-Z plane with the next-to-last cavity 430. The last cavity 440 has a last opening (fifth opening) 155 (FIG. 11) in the last Y-Z plane (fifth X-Y plane). The fifth Y-Z plane is offset from the fourth Y-Z plane by a fourth length $L_4$ along the X axis. The fifth opening 155 (FIG. 11) in the $Y_5$-$Z_5$ plane of the fourth cavity 440 is an input port or output port of the waveguide 446 formed from the fourth cavity 440 when the metal cover is attached to the $X_1$-$Y_1$ surface.

The four cavities 410, 420, 430, and 440 concurrently step the height and width of the waveguide to provide the 90° twist effect. The interfacing device 420/430 formed from the two waveguides 426 and 436 (FIG. 11), which include the respective cavities 420 and 430 shown in FIGS. 9-11, provides a broader operating bandwidth than the single cavity interfacing device 60 shown in FIGS. 1 and 2. Although the illustrated embodiments include 1 or 2 quarter-wave transition cavities more than two quarter-wave transition cavities can be designed and fabricated for a broader operating bandwidth. The bandwidth and size of the structure will both improve as more sections are added as is known in the art.

Figure 12:
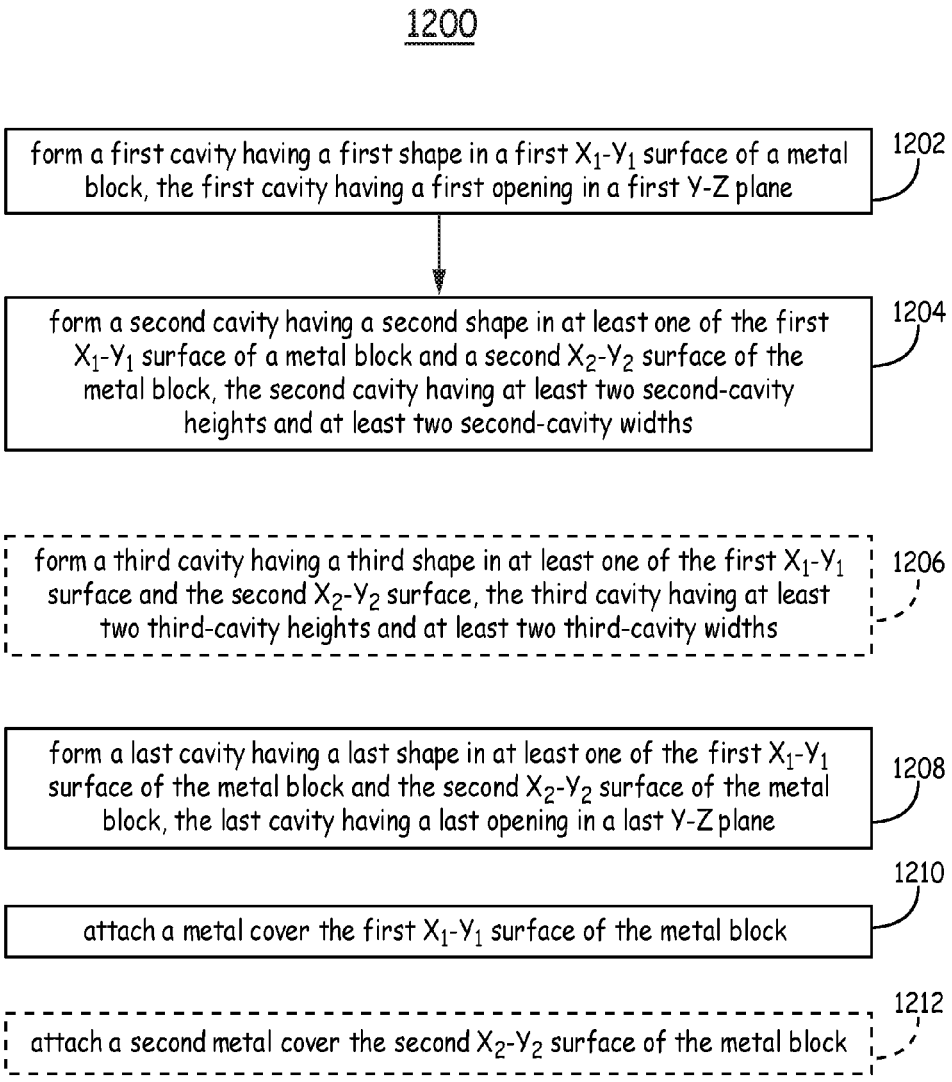
FIG. 12 is a flow diagram of one embodiment of a method to form a twist for coupling electro-magnetic radiation between orthogonal waveguides in accordance with the teachings of the present application.

FIG. 12 is a flow diagram of one embodiment of a method 1200 to form a twist for coupling electro-magnetic radiation between orthogonal waveguides in accordance with the teachings of the present application. The method 1200 is used to form any of the twists 5, 6, 7, and 8 described herein.

At block 1202, a first cavity having a first shape is formed in a first $X_1$-$Y_1$ surface of a metal block. The first cavity has a first opening in a first Y-Z plane and a second opening in a second Y-Z plane. The second Y-Z plane is offset from the first Y-Z plane by a first length $L_1$ along an X axis.

At block 1204, a second cavity having a second shape is formed in at least one of the first $X_1$-$Y_1$ surface of the metal block and an opposing second $X_2$-$Y_2$ surface of the metal block. The twist 8 shown in FIG. 11 requires second cavity 420 to be formed in both the first $X_1$-$Y_1$ surface of the metal block 15 and the opposing second $X_2$-$Y_2$ surface of the metal block 15.

The second cavity shares the second opening in the second Y-Z plane with the first cavity. The second cavity has a third opening in a third Y-Z plane that is offset from the second Y-Z plane by a second length along the X axis. The second cavity has at least two heights and at least two widths. The at least two heights and at least two widths are associated with each other and are due to at least one step in the second cavity.

In one implementation of this embodiment, the second cavity is formed with two second-cavity heights along the Z axis and the second cavity is formed with two second-cavity widths along a Y axis. In another implementation of this embodiment, the second cavity is formed with three second-cavity heights along the Z axis and the second cavity is formed with three second-cavity widths along a Y axis. In yet another implementation of this embodiment, the second cavity is formed with more than three second-cavity heights along the Z axis and the second cavity is formed with more than three second-cavity widths along a Y axis. In yet another implementation of this embodiment, a dielectric material is positioned in the second cavity.

Block 1206 is optional. The twist 5 shown in FIG. 1 is formed without implementing block 1206. At block 1206, a third cavity having a third shape is formed in at least one of the first $X_1$-$Y_1$ surface and the opposing second $X_2$-$Y_2$ surface. The twist 8 shown in FIG. 11 requires third cavity 430 to be formed in both the first $X_1$-$Y_1$ surface of the metal block 15 and the opposing second $X_2$-$Y_2$ surface of the metal block 15.

The third cavity shares the third opening in the third Y-Z plane with the second cavity. The third cavity has a fourth opening in a fourth Y-Z plane that is offset from the third Y-Z plane by a third length along the X axis. The third cavity has at least two heights and at least two widths. The at least two heights and at least two widths are associated with each other and are due to at least one step in the third cavity.

In one implementation of this embodiment, the third cavity is formed with two third-cavity heights along the Z axis and the third cavity is formed with two third-cavity widths along a Y axis. In another implementation of this embodiment, the third cavity is formed with three third-cavity heights along the Z axis and the third cavity is formed with three third-cavity widths along a Y axis. In yet another implementation of this embodiment, the third cavity is formed with more than three third-cavity heights along the Z axis and the third cavity is formed with more than three third-cavity widths along a Y axis. In yet another implementation of this embodiment, a dielectric material is positioned in the third cavity.

At block 1208, a last cavity having a last shape is formed in at least one of the first $X_1$-$Y_1$ surface of the metal block and the opposing second $X_2$-$Y_2$ surface of the metal block. The last cavity has a last opening in a last Y-Z plane that is offset from a next-to-last Y-Z plane by a last length. As described above, in some embodiments, the last cavity is a fourth cavity or a third cavity. In one implementation of this embodiment, a first height along a Z axis of the first cavity is formed to be approximately equal to a last width of the last cavity along a Y axis of the last cavity. In another implementation of this embodiment, a last height along a Z axis of the last cavity is formed to be approximately equal to a first width of the first cavity along a Y axis of the first cavity. In yet another implementation of this embodiment, there are more than four cavities formed in the metal block.

The shapes of the cavities formed in blocks 1202, 1204, 1206, and 1208 are designed using commercial 3D electromagnetic design software. The designer adds one or more quarter-wave waveguide interfacing sections (e.g., such as the second and third cavities formed in blocks 1204 and 1206) that are aligned between an E-plane and an H-plane waveguide section (e.g., such as the first and last cavities formed in blocks 1202 and 1208). Each quarter-wave section is constructed of several diagonally aligned subsections formed from one or more steps formed in the one or more quarter-wave waveguide interfacing sections. The angle between the sections is selected to be closer to that of an E-plane orientation closer to the E-plane waveguide and closer to an H-plane orientation for the sections closer to the H-plane waveguide. Once the basic design is determined, the designer optimizes the size, length, and orientation of the subsections formed by the steps in each interfacing section to meet the return loss goal over a desired bandwidth. Typically, a quarter-wavelength is an approximate length to these interfacing sections and the actual length is optimized for performance. The designer ensures that the dimensions of the individual sections are large enough so that an end mill of a diameter, such as 1/32, can pass through the sections from a single side.

If the desired performance is not met at this point, the designer has various additional options to enhance the performance can be implemented. These additional options include, but are not limited to: 1) add waveguide features manufactured from a second side (e.g., the second $X_2$-$Y_2$ plane), which is opposite from the first side (e.g., the first $X_1$-$Y_1$ plane); 2) add additional matching sections (e.g., add a additional interfacing quarter-wave waveguide section between the first and last cavities formed in blocks 1202 and 1208; 3) add dielectric segments with the size, dielectric constant, and position optimized using the standard design software. The optimization process is repeated after each additional feature is added or modified.

At block 1210, a first metal cover is attached to the first $X_1$-$Y_1$ surface of the metal block from which the cavities are formed. Block 1212 is optional and is only implemented if at least one cavity is machined from the second $X_2$-$Y_2$ surface of the metal block. At block 1212, a second metal cover is attached to the second $X_2$-$Y_2$ surface of the metal block from which the cavities at least a portion of the cavities are formed. In this manner, the cavities are functional as waveguides to electro-magnetic radiation.

Broadband phase offset lines are able to be made in like manner for use in a switched line phase shifter. Advantageously, the technology described herein can be used to form two waveguide runs in a single metal block (or in two adjacently positioned metal blocks) in which the waveguide runs of the same physical length are formed. In one implementation of this embodiment, the two waveguide runs are designed to output two electro-magnetic radiation signals that are polarized parallel to each and that are 180° out of phase with respect to each other. In another implementation of this embodiment, the two waveguide runs are connected to an input ferrite switching circulator and an output ferrite switching circulator in a single mechanical housing assembly (metal block) to form a switched line phase shifter.

Figure 13:
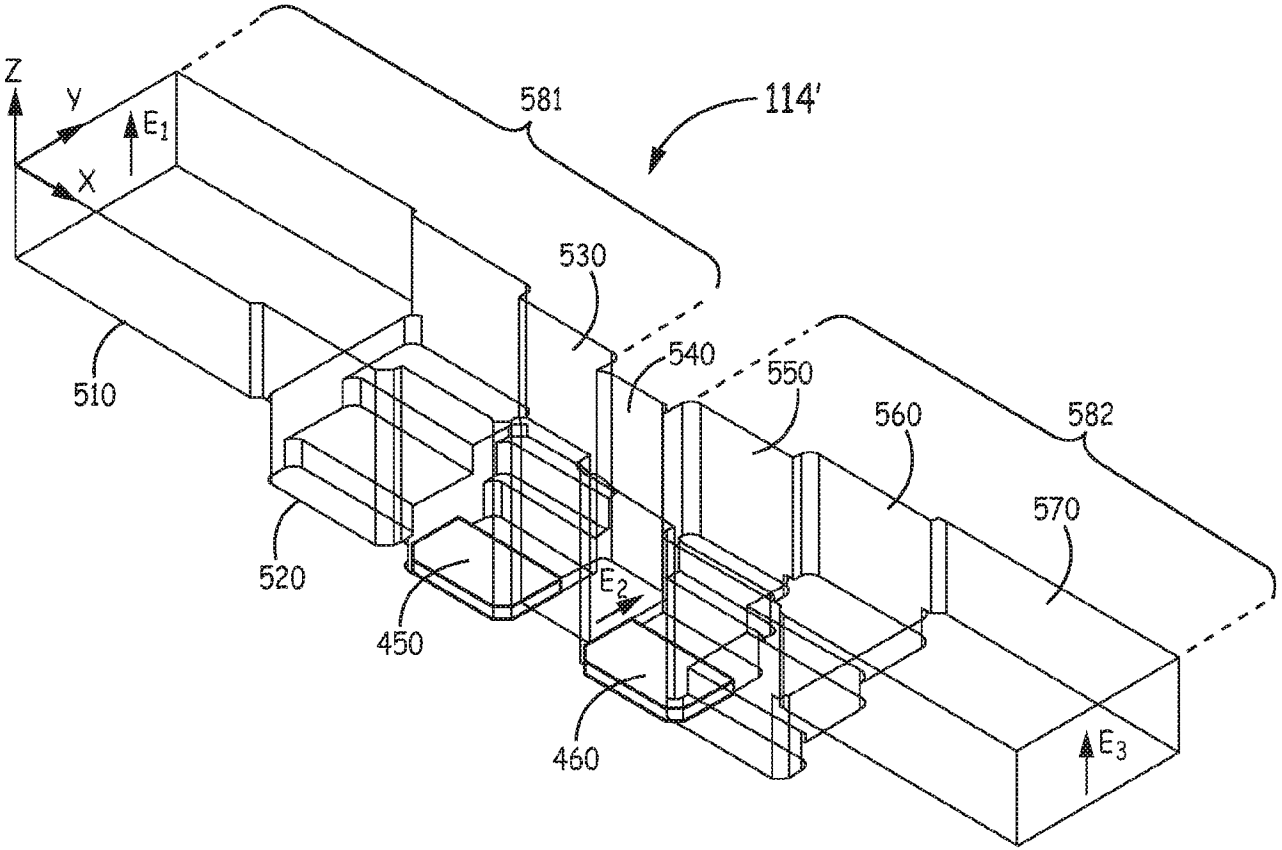
FIG. 13 is an oblique view of one embodiment of cavities in a first-waveguide run for a switch line phase shifter in accordance with the teachings of the present application.
Figure 14:
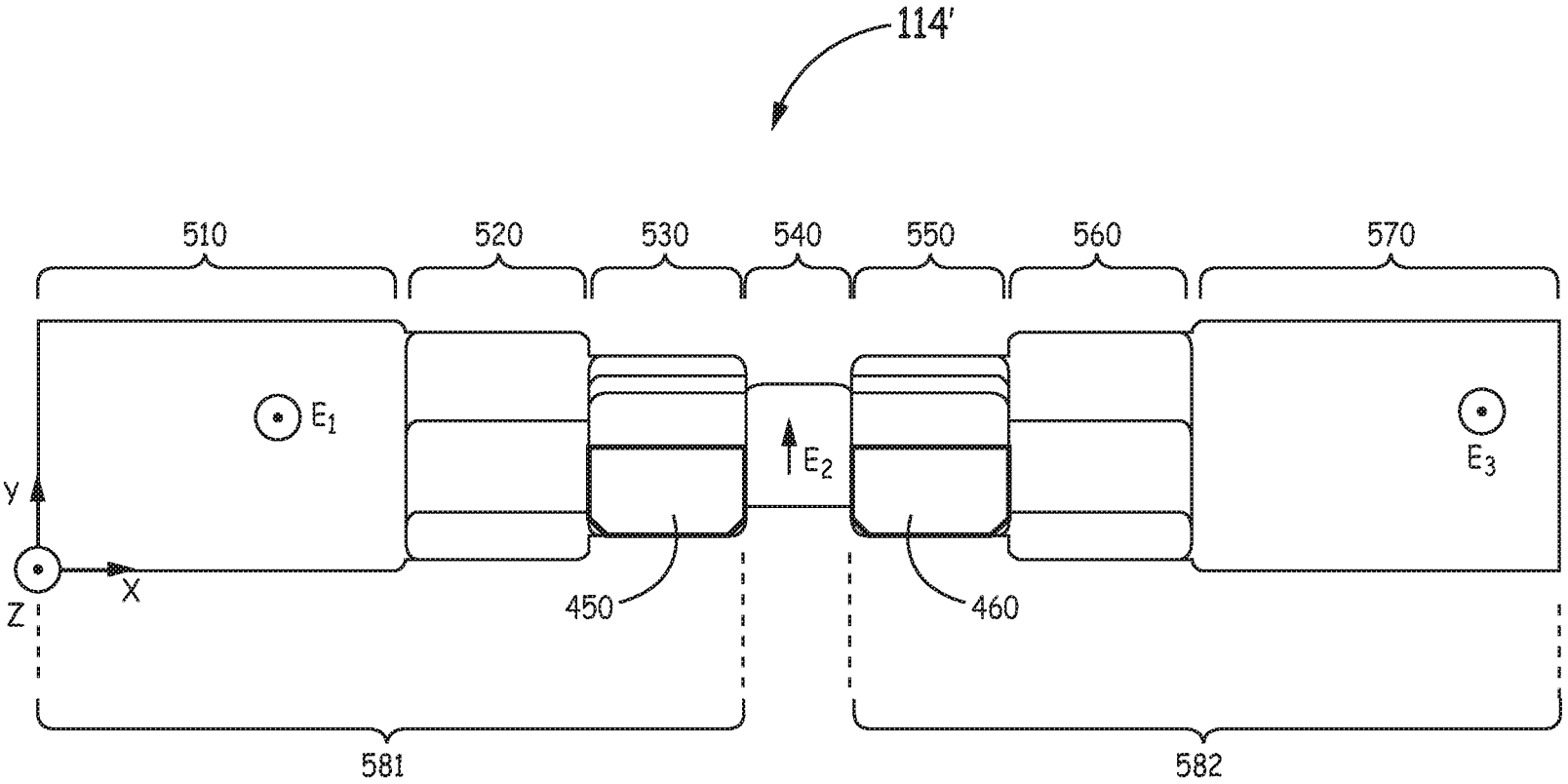
FIG. 14 is a top view of the cavities in the first-waveguide run of FIG. 13 for the switch line phase shifter.
Figure 15:
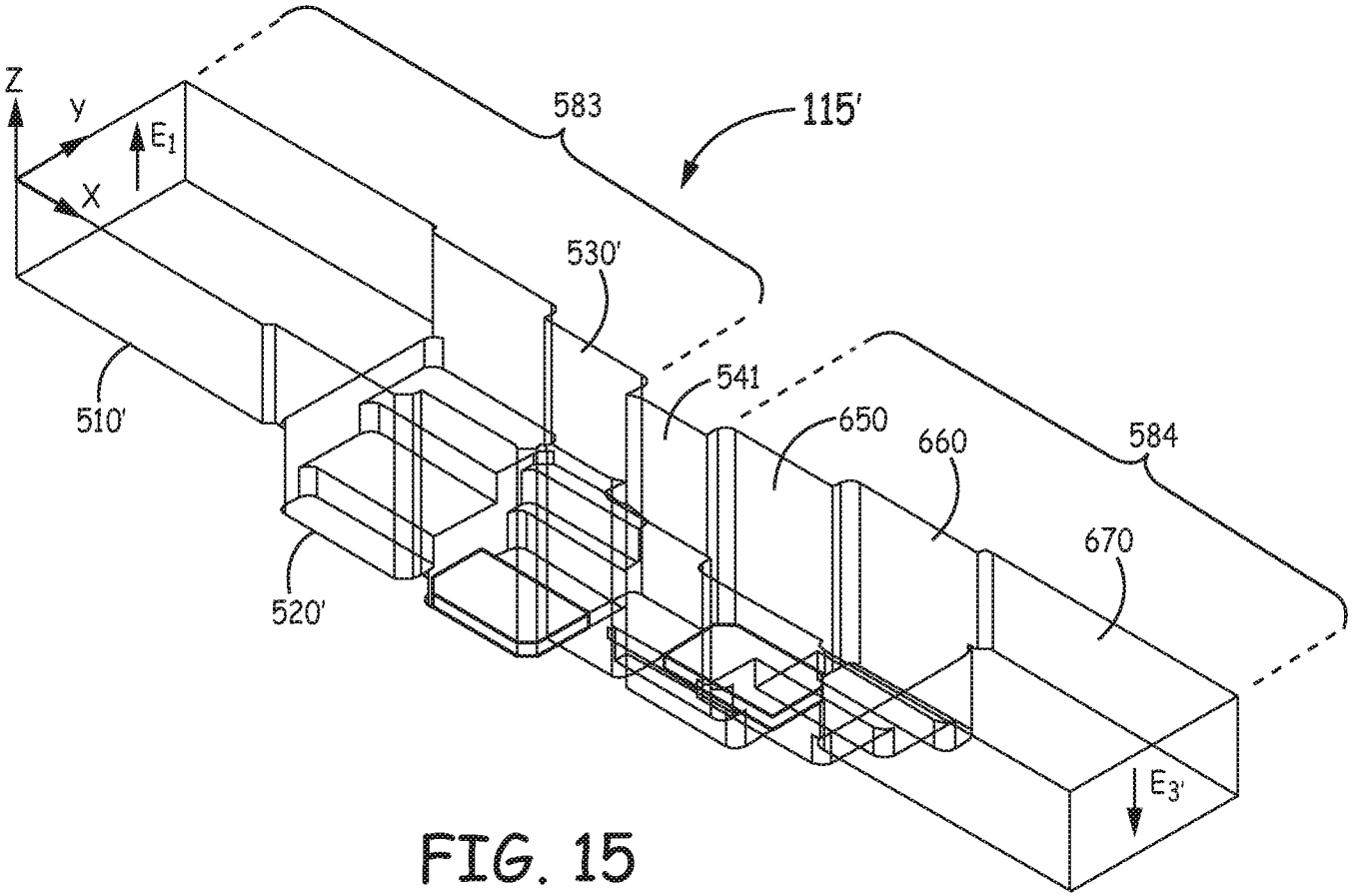
FIG. 15 is an oblique view of one embodiment of cavities in a second-waveguide run for a switch line phase shifter in accordance with the teachings of the present application.
Figure 16:
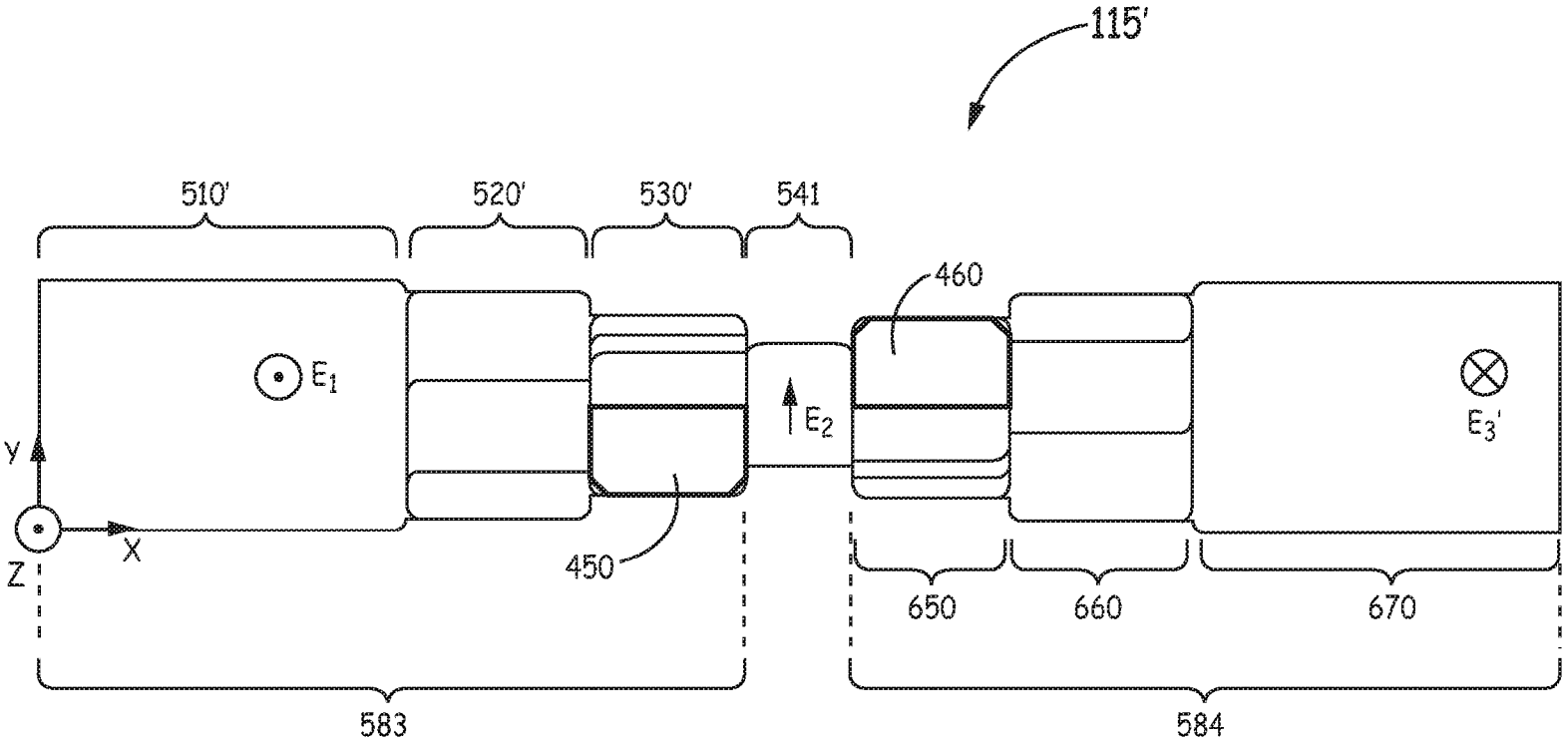
FIG. 16 is a top view of the cavities in the second-waveguide run of FIG. 15 for the switch line phase shifter.
Figure 17:
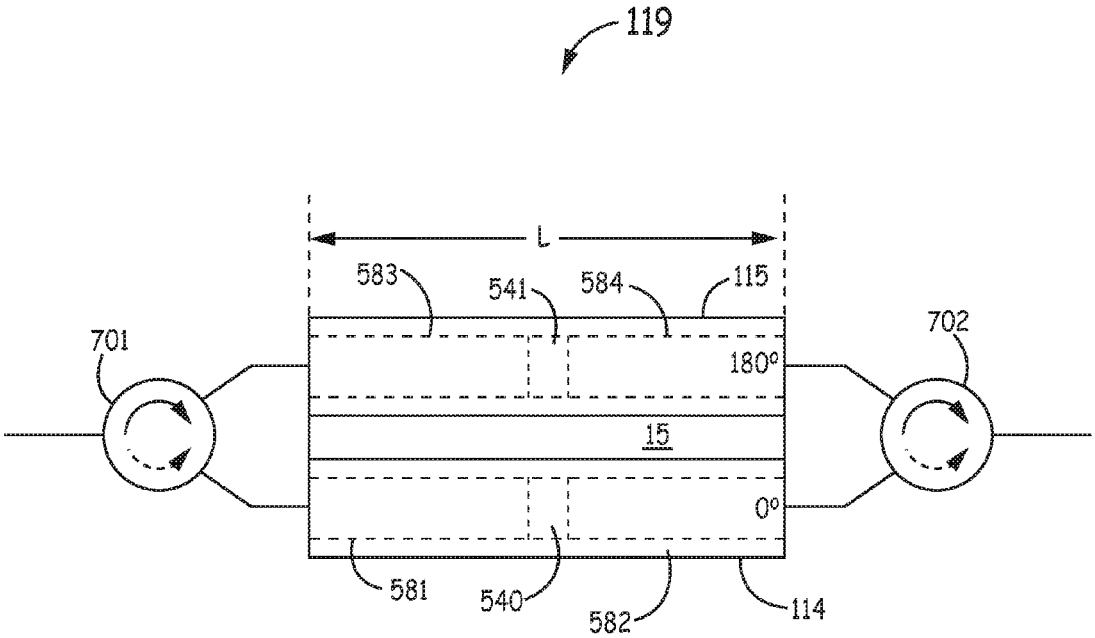
FIG. 17 is a block diagram of a switch line phase shifter including the first-waveguide run of FIGS. 13 and 14 and the second-waveguide run of FIGS. 15 and 16.

FIG. 13 is an oblique view of one embodiment of cavities 510, 520, 530, 540, 550, 560, and 570 in a first-waveguide run 114' for a switch line phase shifter 119 (FIG. 17) in accordance with the teachings of the present application. FIG. 14 is a top view of the cavities 510, 520, 530, 540, 550, 560, and 570 in the first-waveguide run 114' of FIG. 13 for the switch line phase shifter 119. FIG. 15 is an oblique view of one embodiment of cavities 510', 520', 530', 541, 650, 660, and 670 in a second-waveguide run 115' for a switch line phase shifter 119 (FIG. 17) in accordance with the teachings of the present application. FIG. 16 is a top view of the cavities 510', 520', 530', 541, 650, 660, and 670 in the second-waveguide run 115' of FIG. 15 for the switch line phase shifter 119 (FIG. 17). FIG. 17 is a block diagram of a switch line phase shifter 119 including the first-waveguide run 114 of FIGS. 13 and 14 and the second-waveguide run 115 of FIGS. 15 and 16. As defined herein, the first-waveguide run 114' (FIGS. 13 and 14) includes the outlines of the cavities 510, 520, 530, 540, 550, 560, and 570 in the first-waveguide run 114 (FIG. 17) without the surrounding metal in order to clearly indicate the shapes of the cavities 510, 520, 530, 540, 550, 560, and 570 that are formed in metal shown in the first-waveguide run 114 of FIG. 17. Likewise, as defined herein, the second-waveguide run 115' (FIGS. 15 and 16) includes the outlines of the cavities 510', 520', 530', 541, 650, 660, and 670 in the second-waveguide run 115 (FIG. 17) without the surrounding metal in order to clearly indicate the shapes of the cavities 510', 520', 530', 541, 650, 660, and 670 that are formed in metal shown in the second-waveguide run 115 of FIG. 17.

The cavities 510, 520, 530, 540, 550, 560, and 570 in the first-waveguide run 114' and the cavities 510', 520', 530', 541, 650, 660, and 670 in the second-waveguide run 115' all open from at least one of a first $X_1$-$Y_1$ surface of the metal block 15 and an opposing second $X_2$-$Y_2$ surface of the metal block 15.

When a metal cover or covers (e.g., metal cover 16 and/or metal cover 17 as described above) are attached to the metal block 15 from which the cavities 510, 520, 530, 540, 550, 560, and 570 in the first-waveguide run 114 (FIG. 17) and the cavities 510', 520', 530', 541, 650, 660, and 670 in the second-waveguide run 115 (FIG. 17) are formed, the cavities 510, 520, 530, 540, 550, 560, and 570 in the first-waveguide run 114 (FIG. 17) and the cavities 510', 520', 530', 541, 650, 660, and 670 in the second-waveguide run 115 (FIG. 17) function as waveguides through which electro-magnetic radiation is able to propagate.

The cavities 510, 520, 530, 550, 560, and 570 in the first-waveguide run 114' and the cavities 510', 520', 530', 650, 660, and 670 in the second-waveguide run 115' are also referred herein to as follows: first cavity 510; second cavity 520; third cavity 560; fourth cavity 570; fifth cavity 510'; sixth cavity 520'; seventh cavity 660; eighth cavity 670; ninth cavity 530; tenth cavity 550; eleventh cavity 530'; and twelfth cavity 650. In one implementation of this embodiment, the first-waveguide run 114' and the second-waveguide run 115' do not include the ninth cavity 530, the tenth cavity 550, the eleventh cavity 530', and the twelfth cavity 650.

The first-waveguide run 114 (FIG. 17) includes a first twist 581, a second twist 582, and a first connecting cavity 540 (FIG. 17). The first connecting cavity 540 couples electro-magnetic radiation propagating along an X axis between the first twist 581 and the second twist 582. The first twist 581 rotates the electro-magnetic radiation by 90 degrees. The second twist 582 rotates the electro-magnetic radiation by 90 degrees in the opposite direction. In this manner, the input radiation represented generally as $E_1$ in the cavity 510 is the same polarization as the output electro-magnetic radiation represented generally as $E_3$ in the cavity 570 (FIGS. 13 and 14). The input radiation $E_1$ is in-phase with output radiation $E_3$.

The second-waveguide run 115 includes a third twist 583, a fourth twist 584, and a second connecting cavity 541. The second connecting cavities 540 and 541 have the same shape. The second connecting cavity 541 couples electro-magnetic radiation propagating along an X axis between the third twist 583 and the fourth twist 584. The third twist 583 rotates the electro-magnetic radiation by 90 degrees. The fourth twist 584 rotates the electro-magnetic radiation by an additional 90 degrees in the same direction. The input radiation $E_1$ in the cavity 510' is the same polarization as the output electro-magnetic radiation $E_3'$ in the cavity 670. The input radiation $E_1$ is 180 degrees out of phase with the output radiation $E_3'$. Thus, the output radiation $E_3'$ is 180 degrees out of phase with the output radiation $E_3$.

The first twist 581 includes the first cavity 510, the second cavity 520, and the ninth cavity 530. The first cavity 510, the second cavity 520, and the ninth cavity 530 have three respective shapes. The second twist 582 includes the third cavity 560, the fourth cavity 570, and the tenth cavity 550. The third cavity 560 has the shape of the second cavity 520. The fourth cavity 570 has the shape of the first cavity 510. The ninth cavity 530 has the shape of the tenth cavity 550.

The third twist 583 includes the fifth cavity 510', the sixth cavity 520', and the eleventh cavity 530'. The fifth cavity 510', the sixth cavity 520', and the eleventh cavity 530' have three respective shapes. The fourth twist 584 includes the seventh cavity 660, the eighth cavity 670, and the twelfth cavity 650. The seventh cavity 660 has the shape of the sixth cavity 520' rotated 180 degrees about a Z axis. The eleventh cavity 530' has the shape of the twelfth cavity 650 rotated 180 degrees about a Z axis.

As described above, the electro-magnetic radiation propagating along the X axis from the third twist 583 to the fourth twist 584 is output from the eighth cavity 670 as electro-magnetic radiation $E_3'$ and electro-magnetic radiation propagating along the X axis from the first twist 581 to the second twist 582 that is output from the fourth cavity 570 as electro-magnetic radiation $E_3$. The electro-magnetic radiation $E_3$ is polarized parallel to electro-magnetic radiation $E_3'$ and is 180 degrees out of phase with electro-magnetic radiation $E_3'$. This phase difference between $E_3$ and $E_3'$ is due to the above described difference in shape between: the third cavity 560 in the first-waveguide run 114 and the seventh cavity 660 in the second-waveguide run 115; and the tenth cavity 550 in the first-waveguide run 114 and the twelfth cavity 650 the second-waveguide run 115.

The first-waveguide run 114 includes dielectric material 450 in cavity 530 and dielectric material 460 in cavity 550. The second-waveguide run 115 includes dielectric material 450 in cavity 530' and dielectric material 460 in cavity 650. In one implementation of this embodiment, the first-waveguide run 114 and the second-waveguide run 115 do not include dielectric materials.

The switch line phase shifter 119, as shown in FIG. 17, includes the first-waveguide run 114 of FIGS. 13 and 14 and the second-waveguide run 115 of FIGS. 15 and 16, at least one metal cover (not visible in FIG. 17) attached to at least the first $X_1$-$Y_1$ surface of the metal block 15, a first switch 701, and a second switch 702. The cavities of first-waveguide run 114 and the second-waveguide run 115 are formed from at least one of the first $X_1$-$Y_1$ surface of a metal block 15 and an opposing second $X_2$-$Y_2$ surface of the metal block 15.

If any of the cavities 510, 520, 530, 540, 550, 560, 570, 510', 520', 530', 541, 650, 660, and 670 in the first, second, third, and fourth twists or first and second connecting cavities 540, and 541 are formed in the second $X_2$-$Y_2$ surface of the metal block 15, then the switch line phase shifter 119 includes a second metal cover (e.g., metal cover 17).

The first switch 701 is arranged to one of output or input electro-magnetic radiation to or from one of the first twist 581 and the third twist 853. A second switch 702 is arranged to respectively one of input or output electro-magnetic radiation from or to one of the second twist 852 and the fourth twist 854.

For a first direction of electromagnetic signal propagation, the first twist 581 and the third twist 583 are arranged to input electro-magnetic radiation from the first switch 701 and the second twist 582 and the fourth twist 584 are arranged to output electro-magnetic radiation to the second switch 702. If an electro-magnetic signal is input to the first twist 581 from the first switch 701, the electro-magnetic signal is output from the second twist 582 to the second switch 702. Likewise, if an electro-magnetic signal is input to the third twist 583 from the first switch 701, the electro-magnetic signal is output from the fourth twist 584 to the second switch 702. The electro-magnetic signal propagates through one of the first-waveguide run 114 or the second-waveguide run 115 at any given time. The switch line phase shifter 119 is operable to switch between having the electro-magnetic radiation propagate through the first-waveguide run 114 to having the electro-magnetic radiation propagate through the second-waveguide run 115 and vice versa. Thus, the switch line phase shifter 119 is a compact device milled from a single housing structure configured to provide a switchable phase shift of 180 degrees.

The switch line phase shifter 119 is bidirectional so the electro-magnetic radiation can propagate in the opposite direction. Other configurations are of the switch line phase shifter 119 are possible as is understandable to the one skilled in the art upon reading this document.

EXAMPLE EMBODIMENTS

Example 1 includes a twist for coupling electro-magnetic radiation between orthogonal waveguides, the twist comprising: at least three cavities having at least three respective shapes, the at least three cavities opening from at least one of a first $X_1$-$Y_1$ surface of a metal block and an opposing second $X_2$-$Y_2$ surface of the metal block, the at least three cavities comprising: a first cavity having a first opening in a first Y-Z plane and a second opening in a second Y-Z plane that is offset from the first Y-Z plane by a first length along an X axis; a second cavity sharing the second opening in the second Y-Z plane with the first cavity, the second cavity having a third opening in a third Y-Z plane that is offset from the second Y-Z plane by a second length along the X axis, the second cavity having at least two heights and at least two widths; and a last cavity sharing a next-to-last opening in a next-to-last Y-Z plane with a next-to-last cavity, the last cavity having a last opening in a last Y-Z plane that is offset from the next-to-last Y-Z plane by a last length along the X axis, wherein the orthogonal waveguides are formed from the first cavity and the last cavity.

Example 2 includes the twist of Example 1, wherein the at least three cavities having the at least three respective shapes comprise four cavities having four respective shapes, wherein the at least two heights is at least two second-cavity heights, and wherein the at least two widths is at least two second-cavity widths, the twist further comprising: a third cavity sharing the third opening in the third Y-Z plane with the second cavity, the third cavity having a fourth opening in a fourth Y-Z plane that is offset from the third Y-Z plane by a third length along the X axis, the third cavity having at least two third-cavity heights and least two third-cavity widths, wherein the last cavity is a fourth cavity, and wherein sharing the next-to-last opening in the next-to-last Y-Z plane with the next-to-last cavity comprises sharing the fourth opening in the fourth Y-Z plane with the third cavity, and wherein the last cavity having the last opening in the last Y-Z plane comprises the fourth cavity having a fifth opening in a fifth Y-Z plane, the fifth Y-Z plane offset from the fourth Y-Z plane by a fourth length along the X axis.

Example 3 includes the twist of Example 2, wherein the at least two second-cavity heights includes three second-cavity heights in the second cavity along the Z axis, and wherein the at least two second-cavity widths includes three second-cavity widths in the second cavity along the Y axis, and wherein the least two third-cavity heights includes three third-cavity heights in the third cavity along a Z axis, and wherein the least two third-cavity widths includes three third-cavity widths in the third cavity along a Y axis.

Example 4 includes the twist of any of Examples 1-3, wherein a height along a Z axis of the first cavity is less than a height along a Z axis of the last cavity and a width along a Y axis of the first cavity is greater than a width along a Y axis of the last cavity, and wherein the height along the Z axis of the first cavity is about equal to the width along the Y axis of the last cavity and the height along the Z axis of the last cavity is about equal to the width along the Y axis of the first cavity.

Example 5 includes the twist of any of Examples 1-4, further comprising at least one metal cover attached to the at least one of the first $X_1$-$Y_1$ surface and the opposing second $X_2$-$Y_2$ surface, wherein the first cavity is one of an input waveguide or an output waveguide while the last cavity is a respective one of the output waveguide or the input waveguide.

Example 6 includes the twist of any of Examples 1-5, further comprising at least one metal cover attached to the at least one of the first $X_1$-$Y_1$ surface and the opposing second $X_2$-$Y_2$ surface, wherein the first opening in the first Y-Z plane is one of an input to an input waveguide or an output to an output waveguide while the last opening in the last Y-Z plane is a respective one of the output to an output waveguide or an input to an input waveguide.

Example 7 includes the twist of any of Examples 1-6, wherein the at least two heights includes three heights along a Z axis in the second cavity, and wherein the at least two widths includes three widths in the second cavity along a Y axis.

Example 8 includes the twist of any of Examples 1-7, further comprising a dielectric material in at least one of the second cavity and the next-to-last cavity.

Example 9 includes a method to form a twist for coupling electro-magnetic radiation between orthogonal waveguides, the method comprising: forming a first cavity having a first shape in a first $X_1$-$Y_1$ surface of a metal block, the first cavity having a first opening in a first Y-Z plane and a second opening in a second Y-Z plane that is offset from the first Y-Z plane by a first length along an X axis; forming a second cavity having a second shape in at least one of the first $X_1$-$Y_1$ surface of the metal block and an opposing second $X_2$-$Y_2$ surface of the metal block, the second cavity sharing the second opening in the second Y-Z plane with the first cavity, the second cavity having a third opening in a third Y-Z plane that is offset from the second Y-Z plane by a second length along the X axis, the second cavity having at least two heights and at least two widths; and forming a last cavity having a last shape in at least one of the first $X_1$-$Y_1$ surface of the metal block and the opposing second $X_2$-$Y_2$ surface of the metal block, the last cavity having a last opening in a last Y-Z plane that is offset from a next-to-last Y-Z plane by a last length.

Example 10 includes the method of Example 9, wherein the at least two heights is at least two second-cavity heights, and wherein the at least two widths is at least two second-cavity widths, the method further comprising: forming a third cavity having a third shape in at least one of the first $X_1$-$Y_1$ surface and the opposing second $X_2$-$Y_2$ surface, the third cavity sharing the third opening in the third Y-Z plane with the second cavity, the third cavity having a fourth opening in a fourth Y-Z plane that is offset from the third Y-Z plane by a third length along the X axis, the third cavity having at least two third-cavity heights and least two third-cavity widths.

Example 11 includes the method of Example 10, wherein forming the last cavity having the last shape comprises: forming a fourth cavity having a fourth shape, the fourth cavity sharing a fourth opening in a fourth Y-Z plane with a third cavity, the fourth cavity having a fifth opening in a fifth Y-Z plane, the fifth Y-Z plane offset from the fourth Y-Z plane by a fourth length.

Example 12 includes the method of any of Examples 10-11, wherein forming the third cavity having the third shape comprises: forming the third cavity with three third-cavity heights along the Z axis; and forming the third cavity with three third-cavity widths along a Y axis.

Example 13 includes the method of any of Examples 10-12, further comprising: positioning a dielectric material in the third cavity.

Example 14 includes the method of any of Examples 9-13, further comprising: positioning a dielectric material in the second cavity.

Example 15 includes the method of any of Examples 9-14, wherein forming the first cavity having the first shape and forming the last cavity having the last shape comprises: forming a first height along a Z axis of the first cavity to be approximately equal to a last width of the last cavity along a Y axis of the last cavity; and forming a last height along a Z axis of the last cavity to be approximately equal to a first width of the first cavity along a Y axis of the first cavity.

Example 16 includes the method of any of Examples 9-15, further comprising: positioning a dielectric material in the second cavity.

Example 17 includes a switched line phase shifter comprising: a first twist comprising at least a first cavity and a second cavity, the first cavity and the second cavity having at least two respective shapes, the first cavity and the second cavity opening from at least one of a first $X_1$-$Y_1$ surface of a metal block and an opposing second $X_2$-$Y_2$ surface of the metal block; a second twist comprising at least a third cavity and a fourth cavity, the third cavity having the shape of the second cavity, the fourth cavity having the shape of the first cavity, the third cavity and the second cavity opening from at least one of the first $X_1$-$Y_1$ surface of the metal block and the opposing second $X_2$-$Y_2$ surface of the metal block; a first connecting cavity coupling electro-magnetic radiation propagating along an X axis between the first twist and the second twist, wherein the first twist, the second twist, and the first connecting cavity open from at least one of the first $X_1$-$Y_1$ surface of the metal block and the opposing second $X_2$-$Y_2$ surface of the metal block; and at least one metal cover attached to at least the first $X_1$-$Y_1$ surface of the metal block.

Example 18 includes the switched line phase shifter of Example 17, further comprising: a third twist comprising at least a fifth cavity and a sixth cavity, the fifth cavity and the sixth cavity having at least two respective shapes, the fifth cavity and the sixth cavity opening from at least one of a first $X_1$-$Y_1$ surface of the metal block and an opposing second $X_2$-$Y_2$ surface of the metal block; a fourth twist comprising at least a seventh cavity and an eighth cavity, the seventh cavity having the shape of the sixth cavity rotated 180 degrees about a Z axis, the seventh cavity and the eighth cavity opening from at least one of the first $X_1$-$Y_1$ surface of the metal block and the opposing second $X_2$-$Y_2$ surface of the metal block; and a second connecting cavity coupling electro-magnetic radiation propagating along the X axis between the third twist and the fourth twist, wherein the third twist, the fourth twist, and the second connecting cavity open from at least one of the first $X_1$-$Y_1$ surface of the metal block and the opposing second $X_2$-$Y_2$ surface of the metal block, wherein electro-magnetic radiation propagating along the X axis from the third twist to the fourth twist is output from the fourth twist 180 degrees out of phase with electro-magnetic radiation propagating along the X axis from the first twist to the second twist that is output from the second twist.

Example 19 includes the switched line phase shifter of Example 18, further comprising: a ninth cavity in the first twist; a tenth cavity in the second twist; a eleventh cavity in the third twist; a twelfth cavity in the fourth twist, the eleventh cavity having the shape of the twelfth cavity rotated 180 degrees about a Z axis.

Example 20 includes the switched line phase shifter of any of Examples 18-19, further comprising: a first switch arranged to one of output or input electro-magnetic radiation to or from one of the first twist and the third twist; and a second switch arranged to respectively one of input or output electro-magnetic radiation from or to one of the second twist and the fourth twist A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

What is claimed is:

1. A switched line phase shifter comprising:

a first twist comprising at least a first cavity and a second cavity, the first cavity and the second cavity having at least two respective shapes, the first cavity and the second cavity opening from at least one of a first $X_1$-$Y_1$ surface of a metal block and an opposing second $X_2$-$Y_2$ surface of the metal block;

a second twist comprising at least a third cavity and a fourth cavity, the third cavity having the shape of the second cavity, the fourth cavity having the shape of the first cavity, the third cavity and the second cavity opening from at least one of the first $X_1$-$Y_1$ surface of the metal block and the opposing second $X_2$-$Y_2$ surface of the metal block;

a first connecting cavity coupling electro-magnetic radiation propagating along an X axis between the first twist and the second twist, wherein the first twist, the second twist, and the first connecting cavity open from at least one of the first $X_1$-$Y_1$ surface of the metal block and the opposing second $X_2$-$Y_2$ surface of the metal block; and at least one metal cover attached to at least the first $X_1$-$Y_1$ surface of the metal block.

2. The switched line phase shifter of claim 1, further comprising:

a third twist comprising at least a fifth cavity and a sixth cavity, the fifth cavity and the sixth cavity having at least two respective shapes, the fifth cavity and the sixth cavity opening from at least one of the first $X_1$-$Y_1$ surface of the metal block and the opposing second $X_2$-$Y_2$ surface of the metal block;

a fourth twist comprising at least a seventh cavity and an eighth cavity, the seventh cavity having the shape of the sixth cavity rotated 180 degrees about a Z axis, the seventh cavity and the eighth cavity opening from at least one of the first $X_1$-$Y_1$ surface of the metal block and the opposing second $X_2$-$Y_2$ surface of the metal block; and a second connecting cavity coupling electro-magnetic radiation propagating along the X axis between the third twist and the fourth twist, wherein the third twist, the fourth twist, and the second connecting cavity open from at least one of the first $X_1$-$Y_1$ surface of the metal block and the opposing second $X_2$-$Y_2$ surface of the metal block, wherein electro-magnetic radiation propagating along the X axis from the third twist to the fourth twist is output from the fourth twist 180 degrees out of phase with electro-magnetic radiation propagating along the X axis from the first twist to the second twist that is output from the second twist.

3. The switched line phase shifter of claim 2, further comprising:

a ninth cavity in the first twist;

a tenth cavity in the second twist;

a eleventh cavity in the third twist;

a twelfth cavity in the fourth twist, the eleventh cavity having the shape of the twelfth cavity rotated 180 degrees about a Z axis.

4. The switched line phase shifter of claim 2, further comprising:

a first switch arranged to one of output or input electro-magnetic radiation to or from one of the first twist and the third twist; and a second switch arranged to respectively one of input or output electro-magnetic radiation from or to one of the second twist and the fourth twist.

* * * * *